US012674263B2

(12) United States Patent
Park et al.

(10) Patent No.: US 12,674,263 B2
(45) Date of Patent: Jul. 7, 2026

(54) WASHING MACHINE WITH DRYING FUNCTION

(71) Applicant: SAMSUNG ELECTRONICS CO., LTD., Suwon-si (KR)

(72) Inventors: Junhong Park, Suwon-si (KR); Younghyun Kim, Suwon-si (KR); Woojin Kim, Suwon-si (KR); Seulgi Lee, Suwon-si (KR); Eungryeol Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 175 days.

(21) Appl. No.: 18/108,054

(22) Filed: Feb. 10, 2023

(65) Prior Publication Data

US 2023/0203731 A1 Jun. 29, 2023

Related U.S. Application Data

(63) Continuation of application No. PCT/KR2022/016726, filed on Oct. 28, 2022.

(30) Foreign Application Priority Data

Dec. 29, 2021 (KR) ..... 10-2021-0191850

(51) Int. Cl.
*D06F 25/00* (2006.01)
*D06F 37/04* (2006.01)
(Continued)

(52) U.S. Cl.
CPC ..... *D06F 25/00* (2013.01); *D06F 37/04* (2013.01); *D06F 37/264* (2013.01); *D06F 39/04* (2013.01);
(Continued)

(58) Field of Classification Search
CPC ..... D06F 25/00; D06F 37/04; D06F 37/264; D06F 39/04; D06F 58/206; D06F 58/22;
(Continued)

(56) References Cited

U.S. PATENT DOCUMENTS 6,343,492 B1 2/2002 Seagar et al.
8,418,376 B2 4/2013 Steffens et al.
(Continued)

FOREIGN PATENT DOCUMENTS

JP 2005304989 * 11/2005
JP 2005304989 A * 11/2005
(Continued)

OTHER PUBLICATIONS

Extended European search report issued Nov. 12, 2024 for International Application No. 22916357.1.
(Continued)

*Primary Examiner* — Michael E Barr
*Assistant Examiner* — Lauren G Orta
(74) *Attorney, Agent, or Firm* — STAAS & HALSEY LLP

(57) ABSTRACT

A washing machine with drying function includes a cabinet, a tub inside the cabinet, and provided with a front opening to allow laundry to be introduced and removed and a back opening, a drum rotatable inside the tub. A heated air supplying device which includes a heat exchange part, an inlet duct disposed at one side of the tub, and formed to guide air that is introduced from a rear side of the heated air supplying device toward the heat exchange part, a supply duct disposed at another side of the tub, and formed to guide air that passed the heat exchange part to be discharged to a front side of the heated air supplying device, and a fan at a
(Continued)

front side the tub, and configured to cause an airflow such that air being discharged from the supply duct is supplied to the front opening of the tub.

14 Claims, 14 Drawing Sheets

(51) Int. Cl.

| | |
|---|---|
| ***D06F 37/26*** | (2006.01) |
| ***D06F 39/04*** | (2006.01) |
| ***D06F 58/02*** | (2006.01) |
| ***D06F 58/04*** | (2006.01) |
| ***D06F 58/20*** | (2006.01) |
| ***D06F 58/22*** | (2006.01) |
| ***D06F 58/24*** | (2006.01) |
| ***D06F 58/26*** | (2006.01) |

(52) U.S. Cl.
CPC ..... *D06F 58/02* (2013.01); *D06F 58/04* (2013.01); *D06F 58/206* (2013.01); *D06F 58/22* (2013.01); *D06F 58/24* (2013.01); *D06F 58/263* (2013.01)

(58) Field of Classification Search
CPC ..... D06F 58/24; D06F 58/02; D06F 58/04; D06F 58/263
See application file for complete search history.

(56) References Cited

U.S. PATENT DOCUMENTS

| | | | |
|---|---|---|---|
| 8,424,347 | B2 | 4/2013 | Maekawa et al. |
| 9,062,405 | B2 | 6/2015 | Yoon et al. |
| 9,163,352 | B2 | 10/2015 | Han et al. |
| 9,212,441 | B2 | 12/2015 | Bison et al. |
| 9,279,211 | B2 | 3/2016 | Kim et al. |
| 9,290,885 | B2 | 3/2016 | Kim et al. |
| 9,746,238 | B2 | 8/2017 | Lim et al. |
| 9,903,067 | B2 | 2/2018 | Ryoo et al. |
| 10,240,276 | B2 | 3/2019 | Ryoo et al. |
| 10,544,542 | B2 | 1/2020 | Kim et al. |
| 10,619,288 | B2 | 4/2020 | Kim et al. |
| 2012/0186305 | A1 | 7/2012 | Taniguchi et al. |
| 2014/0208603 | A1 | 7/2014 | Kim et al. |
| 2014/0208604 | A1 | 7/2014 | Kim et al. |
| 2014/0208609 | A1* | 7/2014 | Han ..... D06F 25/00 34/130 |
| 2014/0230270 | A1 | 8/2014 | Lim et al. |
| 2014/0338218 | A1* | 11/2014 | Contarini ..... D06F 29/005 34/493 |
| 2015/0322610 | A1 | 11/2015 | Garlatti et al. |
| 2015/0345866 | A1 | 12/2015 | Yu et al. |
| 2016/0289881 | A1 | 10/2016 | Song et al. |
| 2017/0159219 | A1 | 6/2017 | Qian et al. |
| 2017/0342646 | A1 | 11/2017 | Qian et al. |
| 2018/0094379 | A1 | 4/2018 | Lee et al. |
| 2018/0266043 | A1 | 9/2018 | Kim et al. |
| 2019/0106832 | A1 | 4/2019 | Cagliani |

FOREIGN PATENT DOCUMENTS

| | | | |
|---|---|---|---|
| JP | 2006-354 | | 1/2006 |
| KR | 2001-0086011 | A | 9/2001 |
| KR | 10-2005-0101807 | | 10/2005 |
| KR | 10-0754876 | | 9/2007 |
| KR | 10-1016302 | | 2/2011 |
| KR | 10-1275198 | B1 | 6/2013 |
| KR | 10-1613962 | B1 | 4/2016 |
| KR | 10-1694158 | | 1/2017 |
| KR | 10-170663 | | 2/2017 |
| KR | 10-2018-0106294 | | 10/2018 |
| KR | 10-2129793 | | 7/2020 |
| KR | 10-2150442 | B1 | 9/2020 |

OTHER PUBLICATIONS

International Search Report dated Feb. 20, 2023 in International Patent Application No. PCT/KR2022/016726 (4 pages; 4 pages English translation).
PCT/ISA/237 dated Feb. 20, 2023 in International Patent Application No. PCT/KR2022/016726 (4 pages).

* cited by examiner

WASHING MACHINE WITH DRYING FUNCTION

CROSS-REFERENCE TO RELATED APPLICATION

This application is a continuation application, under 35 U.S.C. § 111(a), of international application No. PCT/KR2022/016726, filed on Oct. 28, 2022, which is claims priority under 35 U. S. C. § 119 to Korean Patent Application No. 10-2021-0191850 filed on Dec. 29, 2021, the disclosures of which are incorporated herein by reference in their entirety.

BACKGROUND

1. Field

The disclosure relates to a washing machine, and more particularly to a washing machine with drying function capable of washing and drying laundry.

2. Description of Related Art

In general, washing machines which wash laundry and dryers which dry laundry are formed as separate devices.

Accordingly, consumers dry laundry which has completed washing by using a dryer after washing the laundry using a washing machine.

However, in cases where the washing machine and the dryer are formed as separate devices as described above, there is an inconvenience of a user having to wait until the laundry is completed and then move the laundry which has completed washing to the dryer.

To solve the inconvenience described above, a washing machine with drying function has been developed and is being used.

However, the washing machine with drying function of the related art has a problem of the drying function being relatively weaker compared to a drying-only dryer having only the drying function.

SUMMARY

According to an embodiment, a washing machine with drying function may include a cabinet; a tub disposed inside the cabinet, and provided with a front opening to allow laundry to be introduced and removed and a back opening; a drum rotatable inside the tub; and a heated air supplying device above the tub, and configured to supply heated air toward the front opening of the tub. The heated air supplying device may include a heat exchange part which comprises an evaporator and a condenser; an inlet duct disposed at one side of the tub, and formed to guide air that is introduced from a rear side of the heated air supplying device toward the heat exchange part; a supply duct disposed at another side of the tub, and formed to guide air that passed the heat exchange part to be discharged to a front side of the heated air supplying device; and a fan at a front side of the tub, and configured to cause an airflow such that air being discharged from the supply duct is supplied to the front opening of the tub.

The heated air supplying device may include a compressor which is disposed at a back side of the other side.

The blower fan may be configured to rotate about a rotation axis which is disposed along a front and back direction of the washing machine.

The washing machine with drying function may include a back duct formed to connect the tub and the inlet duct.

The washing machine with drying function may include a lint filter disposed inside the inlet duct.

The lint filter may be disposed to be drawn out from the inlet duct.

The washing machine with drying function may include a diaphragm at the front opening of the tub; and a blow duct formed to contain the fan, and connect to the diaphragm.

The washing machine with drying function may include a first circular rib that is provided at a back surface of an outer side of the drum and formed to protrude toward the tub; and a second circular rib that is provided at a back surface of an inner side of the tub and formed to protrude toward the drum.

According to an embodiment, a washing machine with drying function may include a cabinet; a circular tub disposed inside the cabinet, and provided with a front opening to allow laundry to be introduced and removed and a back opening; a diaphragm formed at the front opening of the tub; a drum rotatable inside the tub; and a heated air supplying device configured to supply heated air to the inside of the tub. The heated air supplying device may include a heat exchange part which comprises an evaporator and a condenser; an inlet duct disposed at one side along a length direction of the tub, and formed to guide air being discharged from a rear side of the tub toward the heat exchange part; a supply duct disposed at another side along the length direction of the tub, and formed to guide air that passed the heat exchange part to be discharged to a front side of the tub; a fan at the front side of the tub; and a blow duct formed to contain the blower fan, and connect the supply duct with the diaphragm.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Descriptions below, which takes into reference the accompanying drawings, is provided to assist in a comprehensive understanding of various embodiments of the disclosure as defined by the claims and its equivalent. Although various specific details are included to assist in the understanding herein, the above are to be understood as merely example embodiments. Accordingly, it will be understood by those of ordinary skill in the art that various modifications may be made to various embodiments described herein without departing from the scope and spirit of the disclosure. In addition, descriptions on well-known functions and configurations will be omitted for clarity and conciseness.

Terms and words used in the description below and in the claims are not limited to its bibliographical meaning, and are used merely to assist in a clear and coherent understanding of the disclosure. Accordingly, the description below on the various embodiments of the disclosure are provided simply as examples and it will be clear to those of ordinary skill in the art that the example embodiments as defined by the appended claims and its equivalent are not for limiting the disclosure.

Terms such as first and second may be used in describing various elements, but the elements are not limited by the above-described terms. The above-described terms may be used only for the purpose of distinguishing one element from another element. For example, a first element may be designated as a second element, and likewise, a second element may be designated as a first element without exceeding the scope of protection.

The terms used in the embodiments of the disclosure may be interpreted to have meanings generally understood to one of ordinary skill in the art unless otherwise defined.

In addition, terms such as 'tip end,' 'back end,' 'upper part,' '0 lower part,' 'upper end,' 'lower end,' and the like used in the disclosure may be defined based on the drawings, and forms and locations of each element are not limited by these terms.

The disclosure addresses at least the above-mentioned problems and/or disadvantages and provides a washing machine with drying function having a drying function which is equal to a drying-only dryer.

A washing machine with drying function according to an embodiment will be described in detail below with reference to the accompanied drawings.

Figure 1:
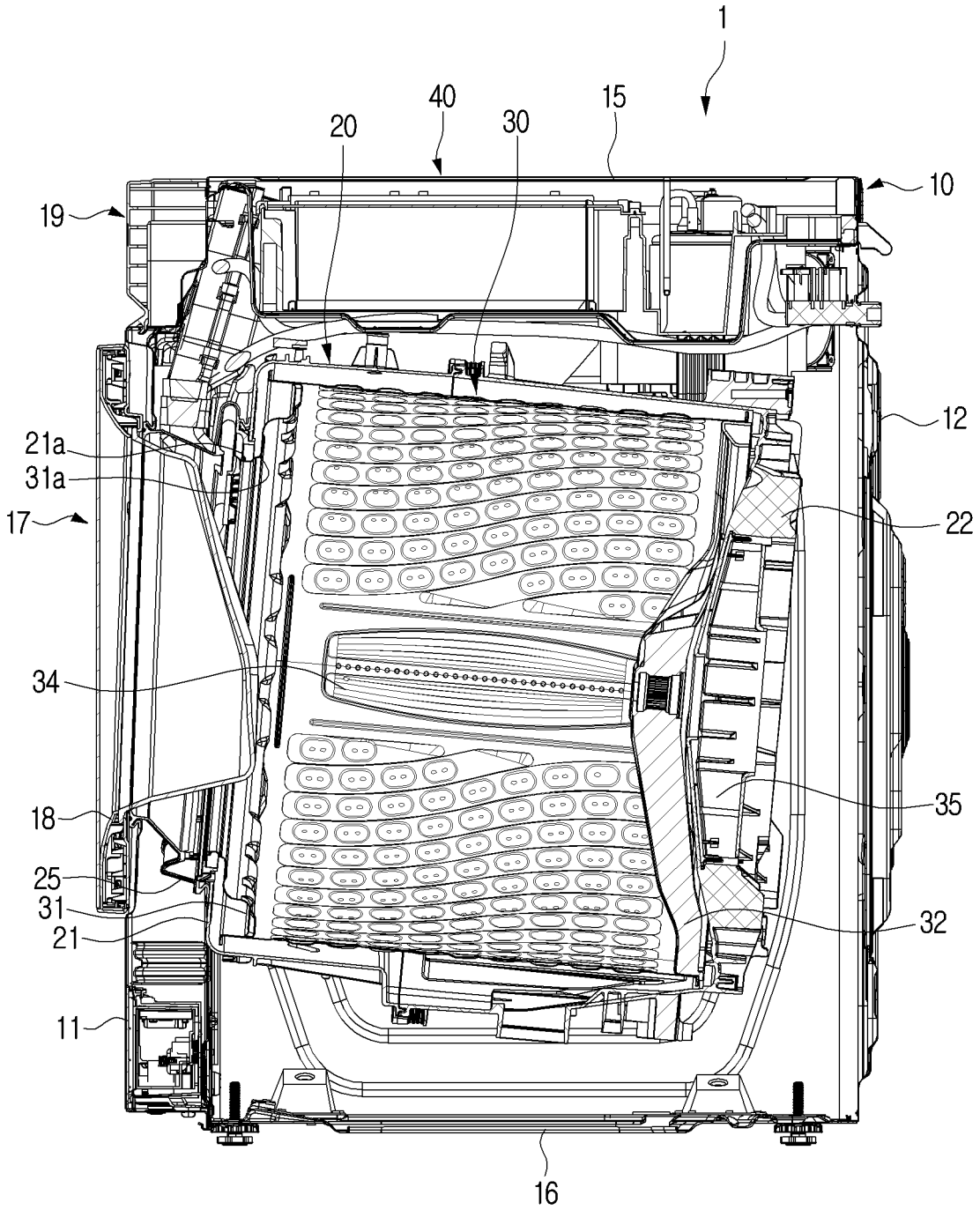
FIG. 1 is a cross-sectional view illustrating a washing machine with drying function according to an embodiment.

FIG. 1 is a cross-sectional view illustrating a washing machine with drying function according to an embodiment.

Referring to FIG. 1, the washing machine with drying function 1 according to an embodiment may include a cabinet 10, a tub 20, a drum 30, and a drying device 40.

The cabinet 10 may form an exterior of the washing machine 1, and may be formed roughly in a rectangular parallelepiped shape. The cabinet 10 may include a front surface cover 11, a back surface cover 12, a left-side cover 13 (referring to FIG. 2), a right-side cover 14 (referring to FIG. 2), an upper cover 15, and a lower cover 16.

At a front surface (or front side) of the cabinet 10, a laundry insertion hole 18 may be provided to load and unload laundry inside of the cabinet 10. That is, the laundry insertion hole 18 may be provided at the front surface cover 11 of the cabinet 10. At the laundry insertion hole 18, a door 17 may be installed so as to be openable and closeable.

At an upper part of the front surface cover 11 of the cabinet 10, a control panel 19 which may control the washing machine 1 may be provided. The control panel 19 may include a plurality of buttons for controlling the washing machine 1, a display to show information associated with the washing machine 1 and a washing process, and a processor configured to control the washing machine 1.

The tub 20 may be installed at an inside of the cabinet 10 of the washing machine 1, and may be formed in a hollow cylindrical shape on which a front opening is provided toward the laundry insertion hole 18 of the front surface cover 11. The front opening of the tub 20 may be connected with the laundry insertion hole 18. The tub 20 may include a back opening provided at a back surface.

The tub 20 may receive washing water of a predetermined amount necessary in washing. The tub 20 may be supported by and fixed to an inner surface of the cabinet 10 through a tension spring, an oil damper, and the like.

In between the tub 20 and the front surface cover 11 of the cabinet 10, a diaphragm 25 may be installed. The diaphragm 25 may be formed roughly in an annular shape. One end of the diaphragm 25 may be fixed to a front surface 21 of the tub 20 at which the front opening is provided, and other end of the diaphragm 25 may be fixed to an inner circumference of the laundry insertion hole 18 of the front surface cover 11 of the cabinet 10. That is, the diaphragm 25 may connect the laundry insertion hole 18 of the cabinet 10 with the front opening of the tub 20.

The diaphragm 25 may be configured such that the washing water contained in the tub 20 is not leaked to an outside of the tub 20, and may form a pathway through which the laundry passes. In addition, the diaphragm 25 may block vibration which is generated when the drum 30 is rotated from being transferred to the front surface cover 11 of the cabinet 10 through the tub 20.

The drum 30 may be installed at an inside of the tub 20 to be rotatable, and may be formed roughly in a hollow cylindrical shape. At a front surface 31 of the drum 30, a drum opening 31*a* corresponding with the laundry insertion hole 18 of the washing machine cabinet 10 may be provided, and at a back end of the drum 30, a back surface plate 32 may be provided.

At a side surface 33 of the drum 30, a plurality of through-holes 33*a* through which the washing water may pass may be provided. The back surface plate 32 of the drum 30 may be provided with a plurality of through-holes 32*a*. Accordingly, air inside the drum 30 may be discharged to a space between the drum 30 and the tub 20 through the plurality of through-holes 33*a* formed at the side surface 33 of the drum 30 and through the plurality of through-holes 32*a* formed at the back surface plate 32.

In addition, at an inner circumferential surface of the drum 30, a plurality of lifts 34 which may raise the laundry may be provided. The drum 30 may rotate about a central axis by a driving device which includes a driving motor 35 installed at the back surface plate 32.

Above the tub 20, a water supply device for supplying water to the tub 20 may be provided, and below the tub 20, a water draining device for draining water from the tub 20 to the outside may be provided.

The water supplying device may include a water supply pipe connected with an external water supply source and a water supply valve which opens and closes the water supply pipe. One end of the water supply pipe may be connected to the diaphragm 25. The water supply pipe may be provided with a detergent intake part.

The water draining device may be formed to discharge the washing water contained in the tub 20 to the outside of the washing machine 1. The water draining device may be installed below the tub 20, and include a pump and a water drain pipe. When the pump is operated, the washing water contained in the tub 20 may be discharged to the outside of the washing machine 1 through the water drain pipe.

Above the tub 20, the drying device 40 may be installed to dry the laundry 35 which was washed by a rotation of the drum 30. The drying device 40 may be configured to generate heated air by heating and drying air which is discharged from the tub 20, and to circulate the heated air to the inside of the tub 20 so as to dry the laundry which is located at an inside of the drum 30.

The drying device 40 of the washing machine with drying function 1 according to an embodiment will be described below with reference to FIG. 2.

Figure 2:
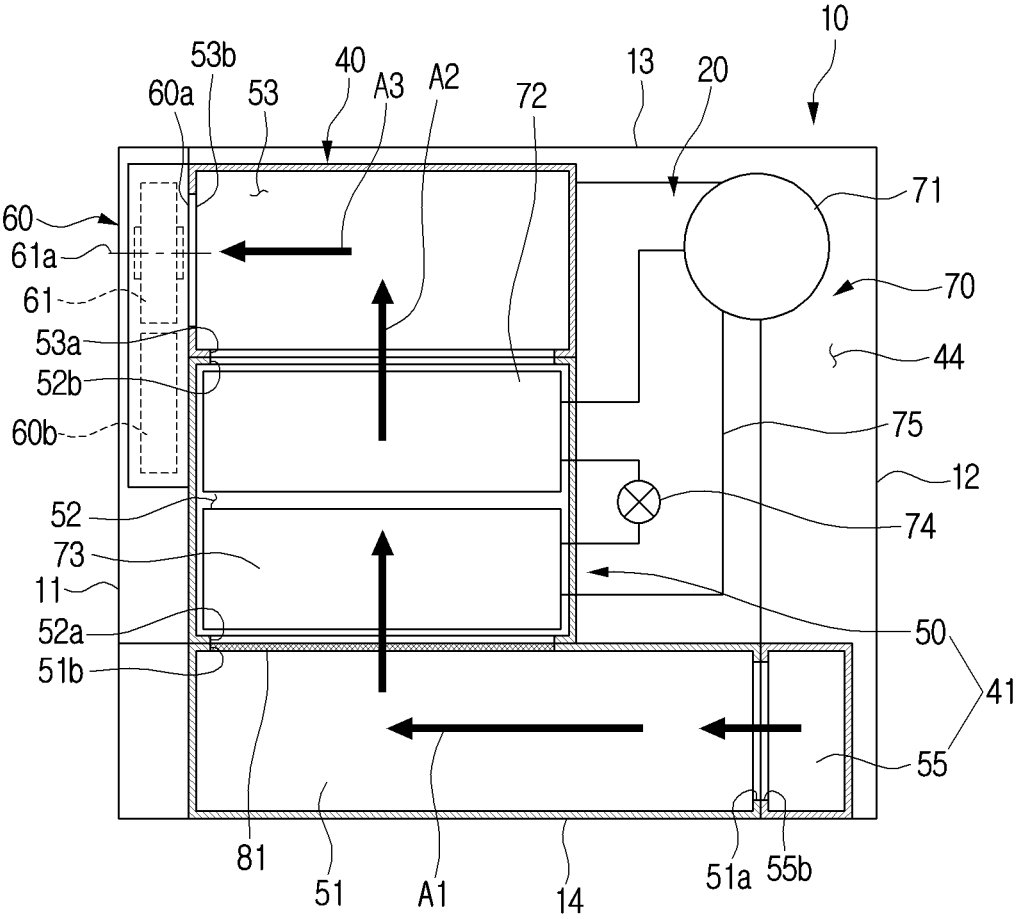
FIG. 2 is a concept view illustrating a drying device of a washing machine with drying function according to an embodiment.

FIG. 2 is a concept view illustrating a drying device of a washing machine with drying function according to an embodiment.

Referring to FIG. 2, the drying device 40 may include a circulating flow path 41 which connects a front side and a back side of the tub 20, a blower fan 61 which generates airflow that circulates the circulating flow path 41, and a heat exchange part 70 which removes moisture included in the airflow that passed the drum 30 and heats the airflow to create a dry airflow in a high temperature, that is, heated air.

The circulating flow path 41 may include an upper flow path 50 provided at the upper side of the tub 20 and a back flow path 55 provided at the back side of the tub 20.

The upper flow path 50 may be formed to connect the back flow path 55 and the front side of the tub 20. The upper flow path 50 may be formed roughly in a L-shape. The upper flow path 50 may be formed such that the airflow which is introduced is bent roughly in a right-angle direction, moved in a straight line by a predetermined distance, and then bent again in the right-angle direction to be discharged to the outside toward the front side of the cabinet 10.

The upper flow path 50 may be installed to be adjacent to the front surface cover 11 of the cabinet 10. Accordingly, a space 44 in which a compressor 71 of the heat exchange part 70 is disposed may be provided between the back surface cover 12 of the cabinet 10 and the upper flow path 50 above the tub 20.

In the embodiment shown in FIG. 2, the upper flow path 50 may be installed adjacent to the front surface cover 11. Accordingly, the space 44 in which the compressor 71 is installed may be provided between the back surface cover 12 and the upper flow path 50.

An inlet Ma of the upper flow path 50 may be provided to be adjacent to one side cover (e.g., right side cover 14) of the cabinet 10. In addition, the inlet Ma of the upper flow path 50 may be provided to be adjacent to the back surface cover 12 of the cabinet 10. An outlet 53*b* of the upper flow path 50 may be provided to be adjacent to the front surface cover 11 of the cabinet 10. The inlet Ma of the upper flow path 50 may be in communication with an outlet 55*b* of the back flow path 55.

The outlet 53*b* of the upper flow path 50 may be provided to be adjacent to other side cover (e.g., left side cover 13) of the cabinet 10. Accordingly, the inlet Ma and the outlet 53*b* of the upper flow path 50 may be positioned at a direction diagonal in an upper surface of the cabinet 10. In other words, the inlet 51*a* of the upper flow path 50 may be provided at one side edge of the cabinet 10, and the outlet 53*b* of the upper flow path 50 may be provided at other side edge of the cabinet 10 positioned at an opposite side in the diagonal direction.

The outlet 53*b* of the upper flow path 50 may be provided with the blower fan 61. The blower fan 61 may be received at an inside of a blow duct 60 which is disposed at the front surface of the tub 20. A suction port 60*a* of the blow duct 60 may be installed to be positioned on a straight line with the outlet 53*b* of the upper flow path 50.

A discharge port 60*b* of the blow duct 60 may be provided to discharge airflow toward the front side of the tub 20. When the diaphragm 25 is provided at the front surface 21 of the tub 20, the discharge port 60*b* of the blow duct 60 may be connected with the diaphragm 25 of the tub 20. At an upper part of the diaphragm 25, an inlet port 25*a* through which airflow is introduced may be provided.

The discharge port 60*b* of the blow duct 60 may be provided to discharge airflow in a straight line toward an inside of the diaphragm 25. Accordingly, an inlet airflow which is introduced into the suction port 60*a* of the blow duct 60 and a discharge airflow which is discharged through the discharge port 60*b* may roughly form a right-angle.

The upper flow path 50 may include an inlet flow path 51, a heat exchange flow path 52, and a supply flow path 53.

The inlet flow path 51 may be provided to be adjacent to one side of the cabinet 10 above the tub 20, that is, one side of the tub 20, and formed for the airflow discharged from the back surface 22 of the tub 20 to be introduced therethrough. The inlet flow path 51 may be formed for the introduced airflow to flow in a straight line.

In the embodiment shown in FIG. 2, the inlet flow path 51 may be provided to be adjacent to the right-side cover 14 of the cabinet 10 above the tub 20, that is, the right-side surface 24 of the tub 20.

The inlet 51*a* of the inlet flow path 51 may be connected with the outlet 55*b* of the back flow path 55. The inlet 51*a* of the inlet flow path 51 may be provided at the back end of the inlet flow path 51, and an outlet 51*b* of the inlet flow path 51 may be provided at one side surface of the inlet flow path 51, that is, the side surface which contacts the heat exchange flow path 52.

The heat exchange flow path 52 may be provided at a right-angle to the inlet flow path 51 above the tub 20, and may be connected with the inlet flow path 51. The heat exchange flow path 52 may be formed for the introduced airflow to flow in a straight line. A width of the heat exchange flow path 52 may be smaller than a length of the inlet flow path 51. Accordingly, the inlet flow path 51 may be formed in a shape protruding from the heat exchange flow path 52 toward the back surface cover 12 of the cabinet 10.

An inlet 52*a* of the heat exchange flow path 52 may be connected with the outlet 51*b* of the inlet flow path 51. The inlet 52*a* of the heat exchange flow path 52 may be provided at one end of the heat exchange flow path 52, and an outlet 52*b* of the heat exchange flow path 52 may be provided at the other end of the heat exchange flow path 52. The outlet 51*b* of the inlet flow path 51 may be formed to have a size corresponding to the inlet 52*a* of the heat exchange flow path 52.

At the outlet 51*b* of the inlet flow path 51, a lint filter 81 may be installed. That is, the lint filter 81 may be installed between the inlet flow path 51 and the heat exchange flow path 52.

The lint filter 81 may be formed to filter foreign material such as lint included in the airflow that is discharged from the tub 20.

The supply flow path 53 may be provided to be adjacent to the other side of the cabinet 10 above the tub 20, that is, the other side of the tub 20, and formed to discharge the airflow introduced from the heat exchange flow path 52 to the blower fan 61. The supply flow path 53 may be connected with the heat exchange flow path 52 at a right-angle. The supply flow path 53 may be formed for the introduced airflow to flow in a straight line.

An inlet 53*a* of the supply flow path 53 may be connected with an outlet 52*b* of the heat exchange flow path 52. The inlet 53*a* of the supply flow path 53 may be provided at one side surface of the supply flow path 53, that is, a side surface which contacts the heat exchange flow path 52. The inlet 53*a* of the supply flow path 53 may be formed to have a size corresponding to the outlet 52*b* of the heat exchange flow path 52.

The outlet 53*b* of the supply flow path 53 may be connected with the suction port 60*a* of the blow duct 60. The supply flow path 53 may be formed to discharge the air toward the front side of the cabinet 10 when viewed from an upper side as shown in FIG. 2. Accordingly, the air discharged from the supply flow path 53 may be suctioned into the back surface of the blow duct 60. That is, the air that is discharged from the supply flow path 53 may be suctioned into the blower fan 61 in a direction from the back surface of the cabinet 10 toward the front surface thereof.

For example, the outlet 53*b* of the supply flow path 53 may be connected in a straight line with the suction port 60*a* of the blow duct 60 installed at the front surface 21 of the tub 20. Accordingly, the airflow introduced into the supply flow path 53 may be suctioned in a straight line into the blower fan 61 received in the blow duct 60.

The back flow path 55 may be provided at a back surface plate 22 of the tub 20, and formed to guide the airflow which passed the tub 20 to the upper side of the tub 20. The outlet 55*b* of the back flow path 55 may be provided so as to be biased toward one side in the back surface cover 12 of the cabinet 10, and be connected with the inlet 51*a* of the inlet flow path 51.

At the front surface 21 of the tub 20, a discharge flow path 54 connecting the blow duct 60 and the diaphragm 25 may be installed. The discharge flow path 54 may be formed to discharge the air discharged from the blow duct 60 downward toward the diaphragm 25.

For example, the discharge flow path 54 may be formed to connect the discharge port 60*b* of the blow duct 60 and the inlet port 25*a* of the diaphragm 25 in a straight line. Accordingly, the airflow discharged from the blow duct 60 may be introduced into the inside of the diaphragm 25 in a straight line through the discharge flow path 54.

The blower fan 61 may be formed to form an airflow so that the air discharged from the supply flow path 53 is supplied to the front opening of the tub 20.

The blower fan 61 may be installed at the front side of the tub 20. For example, the blower fan 61 may be installed between the front surface cover 11 of the cabinet 10 and the tub 20. In addition, the blower fan 61 may be disposed in a diagonal direction with respect to the inlet 51*a* of the inlet flow path 51.

The blower fan 61 may rotate about a rotation axis 61*a* which is disposed in the front and back directions. That is, the blower fan 61 may rotate about the rotation axis 61*a* of the blower fan 61 which is disposed in a longitudinal direction of the tub 20. Accordingly, the blower fan 61 may rotate about the rotation axis 61*a* which is disposed to be roughly perpendicular to the front surface 21 of the tub 20. The rotation axis 61*a* of the blower fan 61 may be installed to form a straight line with the supply flow path 53.

The blower fan 61 may be received at an inside of the blow duct 60 which is installed at the front surface of the tub 20. The blower fan 61 may be installed to be rotatable about the rotation axis 61*a* at the inside of the blow duct 60.

The blow duct 60 may be formed so that the airflow which is discharged from the supply flow path 53 is introduced through the back surface and discharged through a lower surface. That is, the blow duct 60 may be formed so that a discharge direction of the airflow is roughly 90 degrees to an introduced direction of the airflow.

When the blower fan 61 is rotated, the air may be suctioned through the suction port 60*a* of the blow duct 60, pass the blower fan 61, and then be discharged through the discharge port 60*b* which is provided at the lower surface of the blow duct 60. Accordingly, the direction of the airflow discharged from the discharge port 60*b* of the blow duct 60 may roughly form 90 degrees with the direction of the airflow introduced through the suction port 60*a*.

When the blower fan 61 is installed at the front side of the tub 20, the space between the tub 20 and the front surface cover 11 of the cabinet 10 may be used and thus, a size of the blower fan 61 may be maximized.

The heat exchange part 70 may be formed to remove moisture in the air that flows through the circulating flow path 41 and heat the air so as to form a dry air in a high temperature. Hereinafter, the dry air in the high temperature which is formed by the heat exchange part 70 will be referred to as heated air.

The heat exchange part 70 may include the compressor 71, a condenser 72, an evaporator 73, and an expansion valve 74. In addition, the heat exchange part 70 may include a refrigerant pipe 75 which connects the compressor 71, the condenser 72, the evaporator 73, and the expansion valve 74 for a refrigerant to circulate. The heat exchange part 70 may include a heat pump.

The heat exchange part 70 may be formed to remove moisture contained in air and heat the air through heat exchange with the air while the refrigerant discharged from the compressor 71 circulates through the condenser 72, the expansion valve 74, and the evaporator 73.

The evaporator 73 and the condenser 72 may be installed at the upper flow path 50. That is, the evaporator 73 and the condenser 72 may be installed at the heat exchange flow path 52 of the upper flow path 50. The evaporator 73 and the condenser 72 may be installed to be spaced apart at a predetermined distance, and the condenser 72 may be installed at a downstream of the evaporator 73 in a circulating direction of the airflow.

The evaporator 73 may be connected with the back flow path 55, and may remove the moisture by cooling the humid air being discharged from the tub 20.

The condenser 72 may be connected with the blower fan 61, and may heat the air by discharging heat to the air introduced into the tub 20. Accordingly, the blower fan 61 may discharge the dry air in a high temperature, that is, the heated air to the diaphragm 25.

The compressor 71 may be installed at an outer side of the upper flow path 50 above the tub 20. That is, the compressor 71 may be installed at the space 44 provided between the supply flow path 53 of the upper flow path 50 and the back surface of the tub 20.

Accordingly, in the washing machine with drying function 1 according to an embodiment having the structure as described above, when the blower fan 61 operates, the air inside the drum 30 may form an airflow, pass through the back flow path 55, the circulating flow path 41, the blower fan 61, and the discharge flow path 54, and be introduced into the drum 30 again.

At this time, the heat exchange part 70 may operate to remove the moisture from the airflow that is discharged from the drum 30, and raise the temperature of the airflow. That is, the moisture in the airflow may be removed by the evaporator 73 of the heat exchange part 70, and the temperature of the airflow may be raised by the condenser 72. The heated air may be supplied to the drum 30 by the blower fan 61 and dry the laundry within the drum 30.

A main configuration of the washing machine with drying function 1 according to an embodiment will be described in detail below with reference to FIGS. 3 to 7.

Figure 3:
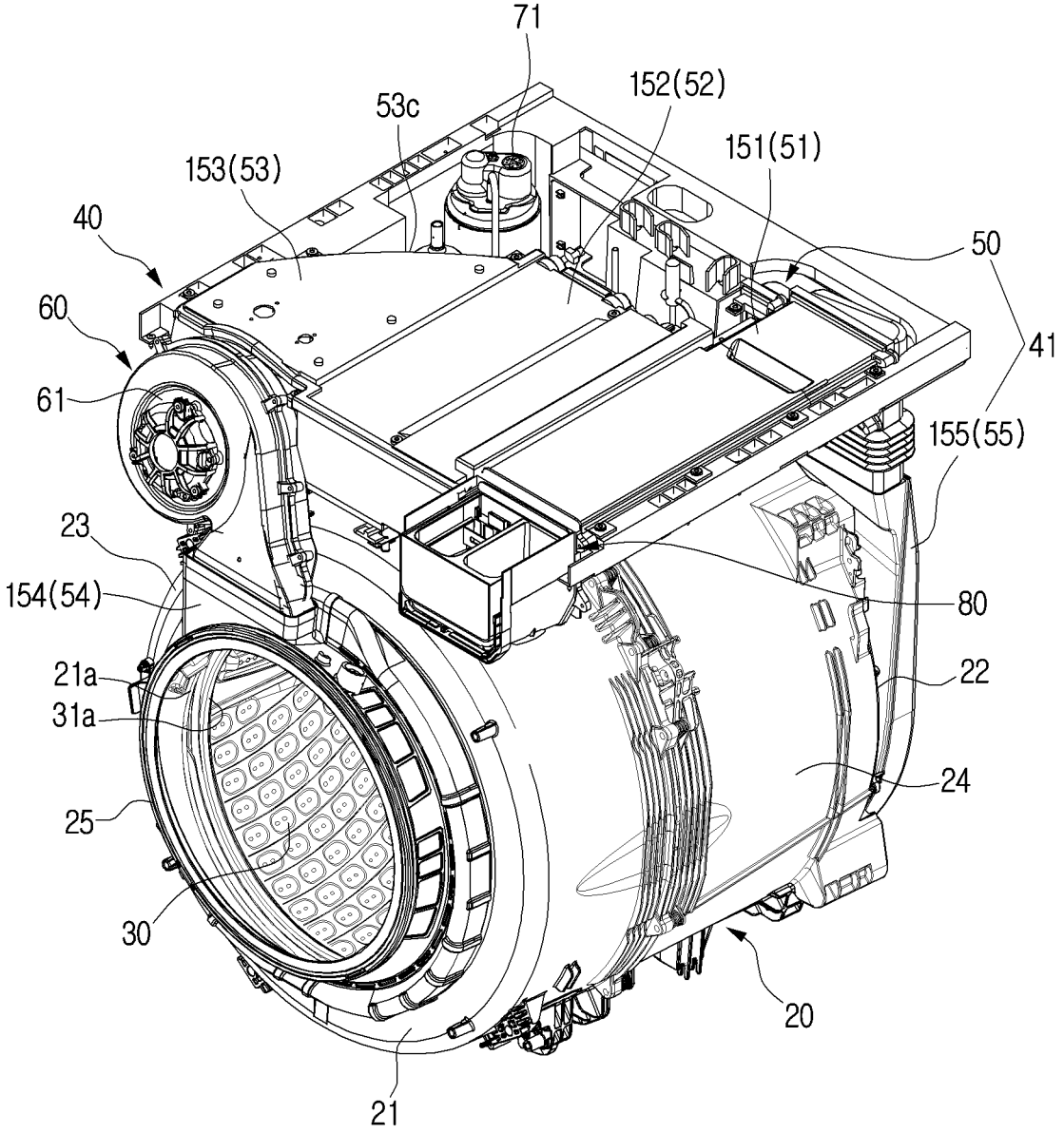
FIG. 3 is a perspective view illustrating a main configuration of a washing machine with drying function according to an embodiment.
Figure 4:
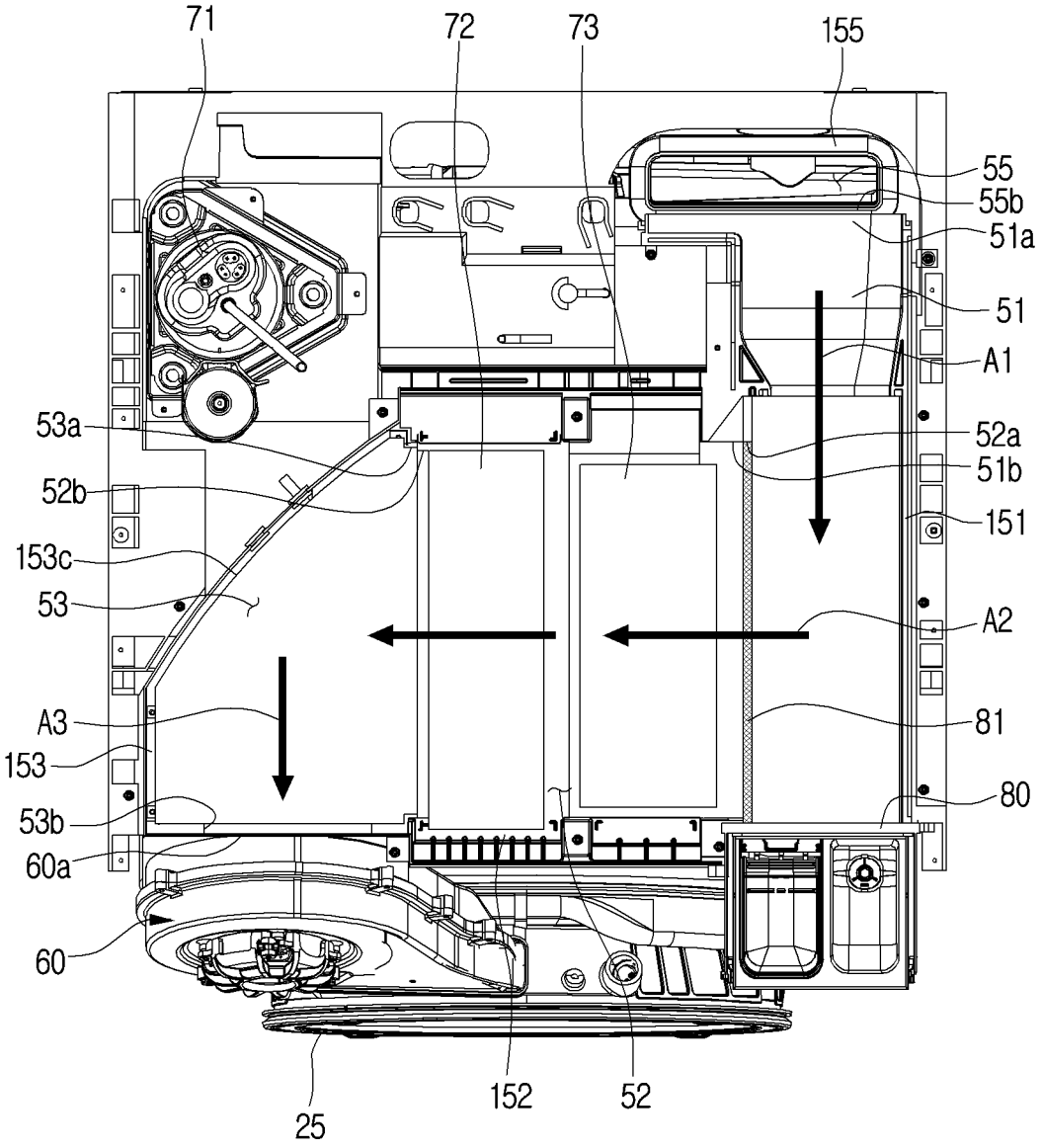
FIG. 4 is a plane view illustrating a main configuration of a washing machine with drying function according to an embodiment.
Figure 5:
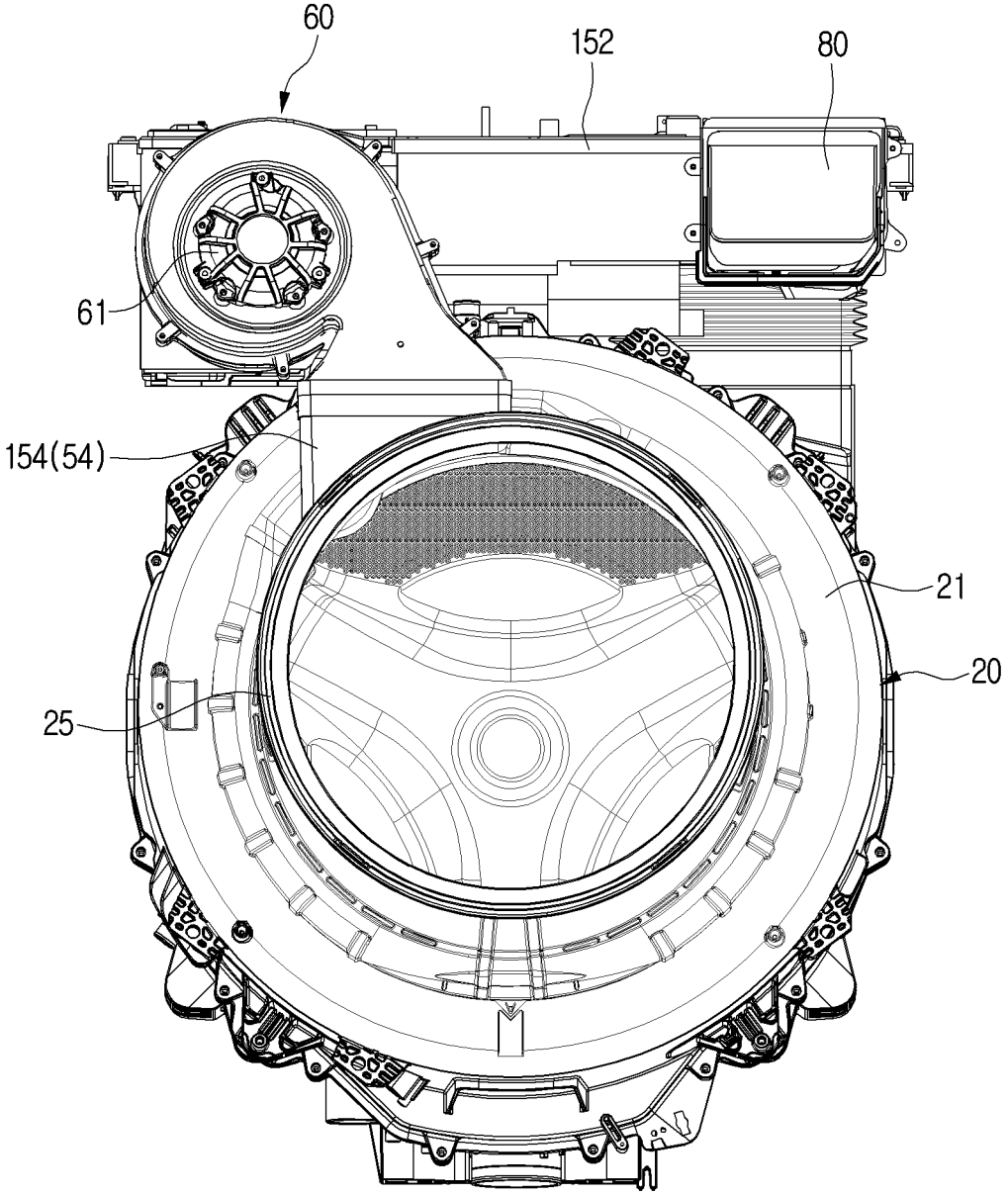
FIG. 5 is a front view illustrating a main configuration of a washing machine with drying function according to an embodiment.
Figure 6:
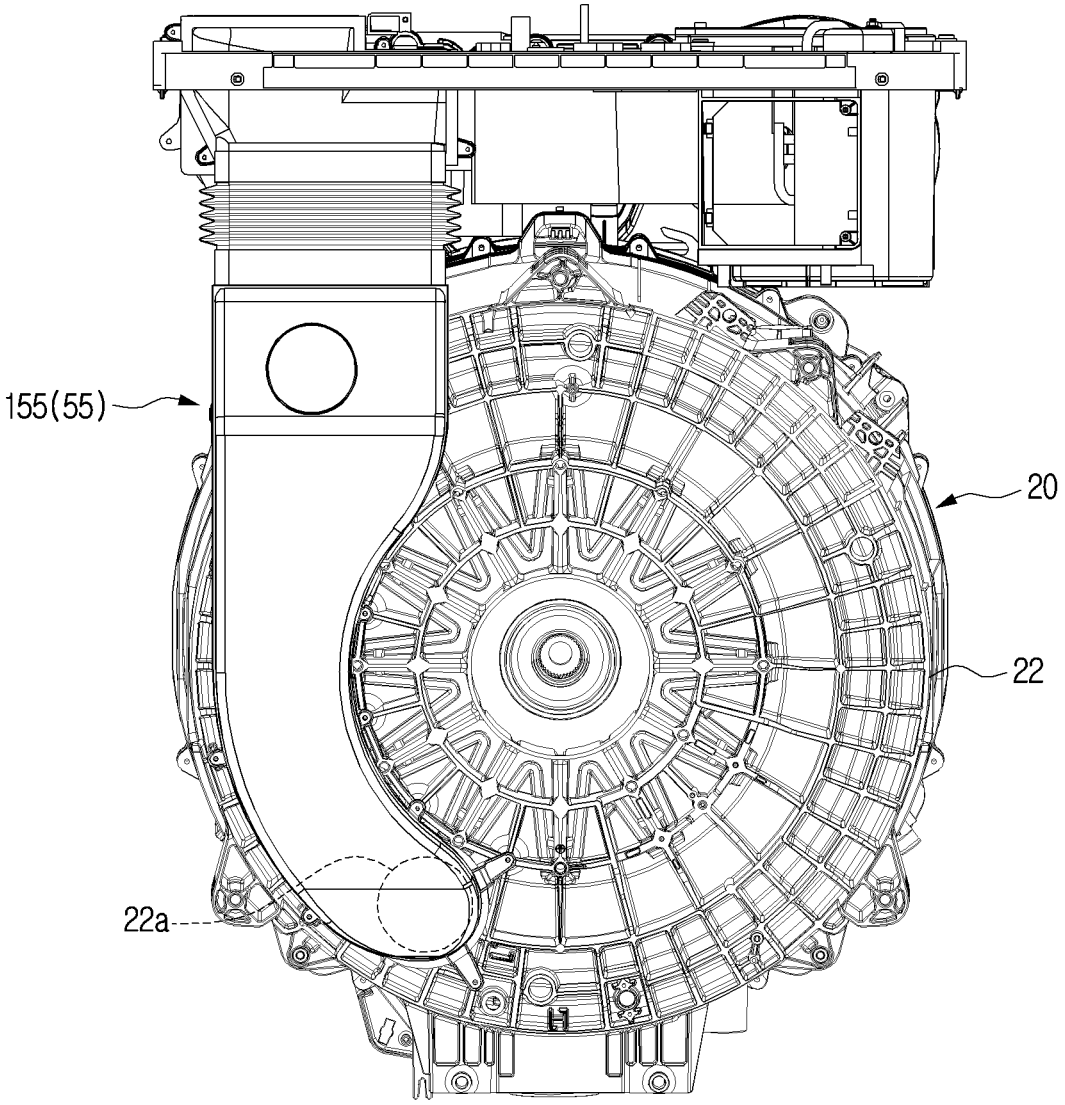
FIG. 6 is a back view illustrating a main configuration of a washing machine with drying function according to an embodiment.
Figure 7:
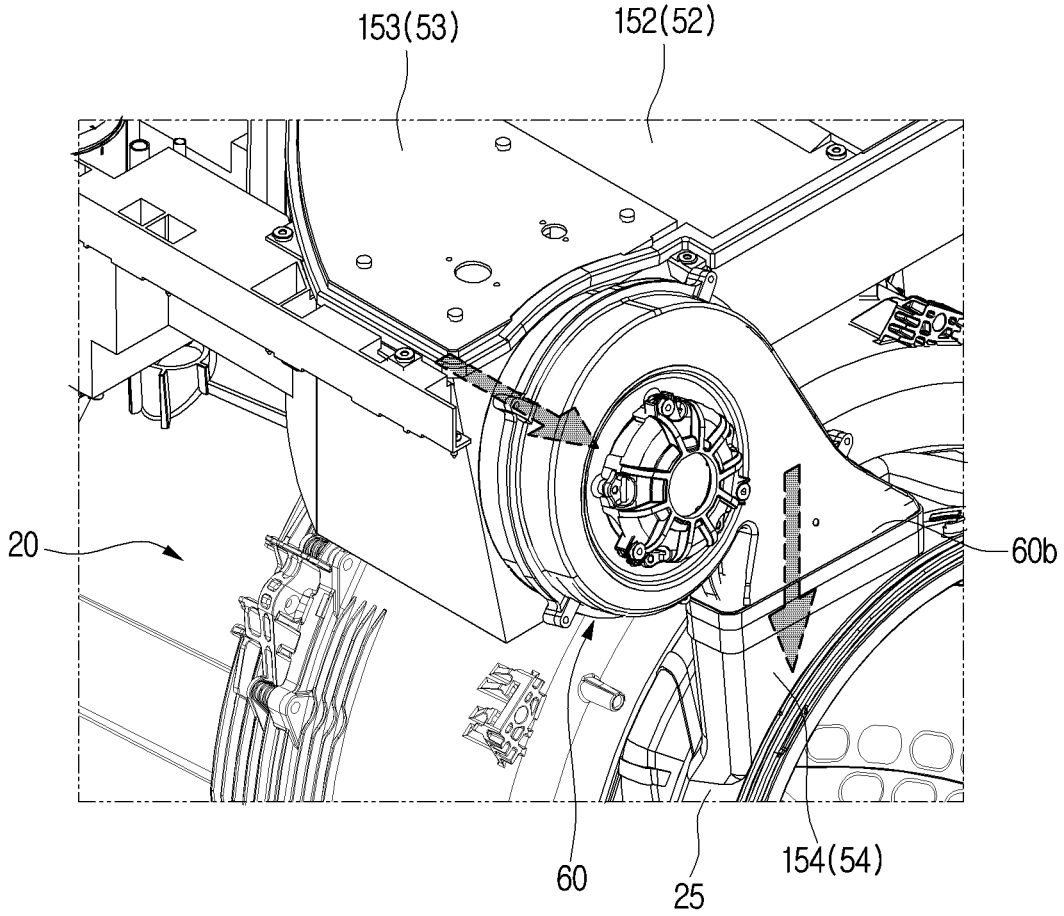
FIG. 7 is a partial perspective view illustrating a blow duct and a supply duct of a washing machine with drying function according to an embodiment.

FIG. 3 is a perspective view illustrating a main configuration of a washing machine with drying function according to an embodiment. FIG. 4 is a plane view illustrating a main configuration of a washing machine with drying function according to an embodiment. FIG. 5 is a front view illustrating a main configuration of a washing machine with drying function according to an embodiment. FIG. 6 is a back view illustrating a main configuration of a washing machine with drying function according to an embodiment. FIG. 7 is a partial perspective view illustrating a blow duct and a supply duct of a washing machine with drying function according to an embodiment.

It is to be noted that FIGS. 3 to 7 only show main configurations for performing the drying in the washing machine with drying function 1 according to an embodiment without the cabinet 10 and other configurations. In addition, FIG. 4 is showing a state in which upper surfaces of an inlet duct 151, a heat exchange duct 152, and a discharge duct 153 are removed to show the inlet flow path 51, the heat exchange flow path 52, and the supply flow path 53.

Referring to FIGS. 3 to 7, the washing machine with drying function 1 according to an embodiment may include the tub 20, the drum 30, and the drying device 40.

The tub 20 may be installed at the inside of the cabinet 10 of the washing machine 1, and formed in a hollow cylindrical shape on which a front opening 21*a* is provided toward the laundry insertion hole 18 of the front surface cover 11. The tub 20 may contain washing water of a predetermined amount necessary in the washing.

At the front surface 21 of the tub 20, the diaphragm 25 may be installed. The diaphragm 25 may be formed roughly in an annular shape. One end of the diaphragm 25 may be fixed to the front surface 21 of the tub 20 at which the front opening 21*a* is provided.

The diaphragm 25 may prevent the washing water contained in the tub 20 from being leaked to the outside of the tub 20, and form a pathway through which the laundry is passed. In addition, the diaphragm 25 may block the vibration that is generated when the drum 30 is rotated from being transferred to the front surface cover 11 of the cabinet 10 through the tub 20.

The drum 30 may be rotatably installed at the inside of the tub 20, and formed roughly in a hollow cylindrical shape. At the front surface 31 of the drum 30, a drum opening 31*a* corresponding to the front opening 21*a* of the tub 20 may be provided, and at the back end of the drum 30, the back surface plate 32 may be provided.

At the side surface 33 of the drum 30, the plurality of through-holes 33*a* through which the washing water can pass may be provided. At the back surface plate 32 of the drum 30, the plurality of through-holes 32*a* may be provided. Accordingly, the air inside the drum 30 may be discharged to the outside of the drum 30 through the through-holes 33*a* formed at the side surface 33 of the drum 30 and the through-holes 32*a* formed at the back surface plate 32.

In addition, at the inner circumferential surface of the drum 30, the plurality of lifts 34 which can raise the laundry 35 may be provided. The drum 30 may be formed so as to rotate by the driving device which includes the driving motor 35 installed at the back surface plate 32.

The drying device 40 may be installed above the tub 20, and may be formed so as to dry the laundry which is washed by the rotation of the drum 30. The drying device 40 may be formed to generate heated air by drying and heating air which is discharged from the tub 20, and to circulate the heated air through the inside of the tub 20 so as to dry the laundry which is located at the inside of the drum 30.

Referring to FIG. 3, the drying device 40 may include the upper flow path 50 which is provided above the tub 20, the back flow path 55 which is provided at the back surface of the tub 20, the blower fan 61 which generates circulating airflow, and the heat exchange part 70 which forms the heated air by removing the moisture contained in the airflow and heating the airflow.

The upper flow path 50 may be formed to connect the back flow path 55 and the front side of the tub 20. The upper flow path 50 may be formed roughly in a L-shape. The upper flow path 50 may be formed such that the airflow which is introduced from the back side is bent in a right-angle direction, moved in a straight line by a predetermined distance, and then bent again in the right-angle direction to be discharged to the outside toward the front side of the cabinet 10.

The upper flow path 50 may be installed to be adjacent to the front surface 21 of the tub 20. Accordingly, the space 44 in which the compressor 71 of the heat exchange part 70 is disposed may be provided between the back surface of the tub 20 and the upper flow path 50 above the tub 20. Here, the front surface 21 of the tub 20 may refer to a surface at which the front opening 21*a* is formed. The one side of the tub 20 may refer to a left side or a right side based on the front surface 21 of the tub 20, and the other side of the tub 20 may refer to an opposite side of the one side of the tub 20 based on the front surface 21 of the tub 20.

In the embodiment shown in FIG. 3, the upper flow path 50 may be installed to be adjacent to the front surface 21 of the tub 20. Accordingly, between the upper flow path 50 and the back surface of the tub 20 above the tub 20, the space 44 in which the compressor 71 is to be installed may be provided.

The inlet 51*a* of the upper flow path 50 may be provided to be adjacent to the one side and the back surface of the tub 20. The inlet 51*a* of the upper flow path 50 may be in communication with the outlet 55*b* of the back flow path 55.

The outlet 53*b* of the upper flow path 50 may be provided to be adjacent to the other side and the front surface 21 of the tub 20. Accordingly, the inlet 51*a* and the outlet 53*b* of the upper flow path 50 may be provided in the diagonal direction above the tub 20. In other words, the inlet 51*a* of the upper flow path 50 may be provided at the one side edge of the tub 20, and the outlet 53*b* of the upper flow path 50 may be provided at the other side edge of the tub 20 which is located at the opposite side in the diagonal direction.

At the outlet 53*b* of the upper flow path 50, the blower fan 61 may be installed. The blower fan 61 may be contained at the inside of the blow duct 60. The suction hole of the blower fan 61 may match with the suction port 60*a* of the blow duct 60. The blow duct 60 may be installed for the suction port 60*a* and the outlet 53*b* of the upper flow path 50 to be positioned on a straight line.

The upper flow path 50 may include the inlet flow path 51, the heat exchange flow path 52, and the supply flow path 53.

The inlet flow path 51 may be provided to be adjacent to the one side of the tub 20 above the tub 20, and formed for the airflow which is discharged from the back surface plate 22 of the tub 20 to be introduced therethrough. The inlet flow path 51 may be formed for the introduced air to flow in a straight line.

The inlet 51*a* of the inlet flow path 51 may be connected with the outlet 55*b* of the back flow path 55. The inlet 51*a* of the inlet flow path 51 may be provided at the back end of the inlet flow path 51, and the outlet 51*b* of the inlet flow path 51 may be provided at one side surface of the inlet flow path 51, that is, the side surface that contacts the heat exchange flow path 52. Accordingly, the outlet 51*b* of the inlet flow path 51 may form a right-angle with the inlet 51*a* of the inlet flow path 51.

At the outlet 51*b* of the inlet flow path 51, the lint filter 81 may be installed. The lint filter 81 may be installed to be separable from the outlet 51*b* of the inlet flow path 51. The lint filter 81 may be installed to be attachable to or detachable from the inlet flow path 51 from the front direction of the tub 20.

The outlet 51*b* of the inlet flow path 51 may be formed to be greater than the inlet 51*a*. For example, the outlet 51*b* of the inlet flow path 51 may be formed to be greater than or equal to two times in size than the inlet 51*a* of the inlet flow path 51. As described above, when the outlet 51*b* of the inlet flow path 51 is formed to be greater than the inlet, the size of the lint filter 81 installed at the outlet 51*b* of the inlet flow path 51 may be formed to be greater.

That is, the lint filter 81 may be formed to a size corresponding to the inlet 52*a* of the heat exchange flow path 52. When the size of the lint filter 81 is made greater, the flow resistance caused by the lint filter 81 may be reduced.

The airflow introduced to the inlet 51*a* of the inlet flow path 51 may be discharged to the inlet 52*a* of the heat exchange flow path 52 after passing the lint filter 81 which is installed at the outlet 51*b*.

The heat exchange flow path 52 may be provided at a right-angle with respect to the inlet flow path 51 above the tub 20, and may connect with the inlet flow path 51. The heat exchange flow path 52 may be formed for the inlet airflow to flow in a straight line.

The width of the heat exchange flow path 52 may be maximized as much as possible to maximize a heat transfer area. However, the width of the heat exchange flow path 52 may be smaller than the length of the inlet flow path 51. For example, the width of the heat exchange flow path 52 may be formed to be greater than or equal to half of the length of the tub 20. Accordingly, the inlet flow path 51 may be formed in a shape which is protruded from the heat exchange flow path 52 toward the back surface cover 12 of the cabinet 10.

The inlet 52*a* of the heat exchange flow path 52 may be provided at one end of the heat exchange flow path 52, and the outlet 52*b* of the heat exchange flow path 52 may be provided at the other end of the heat exchange flow path 52. That is, the inlet 52*a* and the outlet 52*b* of the heat exchange flow path 52 may be provided to face each other in a straight line. The inlet 52*a* and the outlet 52*b* of the heat exchange flow path 52 may be formed to be the same as with a cross-section of the heat exchange flow path 52.

The inlet 52*a* of the heat exchange flow path 52 may be connected with the outlet 51*b* of the inlet flow path 51. The outlet 51*b* of the inlet flow path 51 may be formed to have a shape and size that corresponds to the inlet 52*a* of the heat exchange flow path 52.

The supply flow path 53 may be provided to be adjacent to the other side of the tub 20 above the tub 20, and formed to discharge the airflow introduced from the heat exchange flow path 52 to the blower fan 61. The supply flow path 53 may be connected with the heat exchange flow path 52 at a right-angle. The supply flow path 53 may be formed for the inlet air to flow in a straight line.

The inlet 53*a* of the supply flow path 53 may be connected with the outlet 52*b* of the heat exchange flow path 52. The inlet 53*a* of the supply flow path 53 may be provided at one side surface of the supply flow path 53, that is, the side surface that contacts the heat exchange flow path 52. The inlet 53*a* of the supply flow path 53 may be formed to have a shape and size that corresponds to the outlet 52*b* of the heat exchange flow path 52.

The outlet 53*b* of the supply flow path 53 may be formed at the front surface of the supply flow path 53, and provided at a right-angle with the inlet 53*a* of the supply flow path 53. The outlet 53*b* of the supply flow path 53 may be connected with the suction port 60*a* of the blow duct 60.

The supply flow path 53 may be formed to discharge air toward the front side of the cabinet 10. Accordingly, the air being discharged from the outlet 53*b* of the supply flow path 53 may be suctioned into the back surface of the blow duct 60. That is, the air that is discharged from the outlet 53*b* of the supply flow path 53 may be suctioned into the blower fan 61 in a direction from the back surface of the cabinet 10 toward the front surface thereof.

For example, the outlet 53*b* of the supply flow path 53 may be connected in a straight line with the suction port 60*a* of the blow duct 60 which is installed at the front surface 21 of the tub 20. Accordingly, the airflow introduced to the supply flow path 53 may be suctioned in a straight line into the blower fan 61 which is contained in the blow duct 60.

The discharge port 60*b* of the blow duct 60 may be provided to discharge the airflow downward toward the diaphragm 25 of the tub 20. The discharge port 60*b* of the blow duct 60 may be connected with the diaphragm 25 of the tub 20.

For example, the discharge port 60*b* of the blow duct 60 may be provided to discharge the airflow in a straight line to the inside of the diaphragm 25. Accordingly, the introduced airflow which is introduced through the suction port 60*a* of the blow duct 60 and the discharge airflow which is discharged through the discharge port 60*b* may roughly form a right-angle.

The back flow path 55 may be provided at the back surface plate 22 of the tub 20, and formed to guide the airflow that is discharged from the tub 20 above the tub 20. At the back surface plate 22 of the tub 20, a back opening 22*a* through which the airflow is discharged may be provided. The inlet of the back flow path 55 may be connected with the back opening 22*a* of the tub 20. The outlet 55*b* of the back flow path 55 may be provided so as to biased toward one side on the back surface of the tub 20, and is connected with the inlet 51*a* of the inlet flow path 51.

At the front surface 21 of the tub 20, the discharge flow path 54 that connects the blower fan 61 and the diaphragm 25 may be installed. The discharge flow path 54 may be formed to connect the discharge port 60*b* of the blow duct 60 and the inlet port 25*a* of the diaphragm 25.

For example, the discharge flow path 54 may be formed to connect the discharge port 60*b* of the blow duct 60 and the inlet port 25*a* of the diaphragm 25 in a straight line. Accordingly, the airflow that is discharged from the blow duct 60 may be introduced to the inside of the diaphragm 25 in a straight line through the discharge flow path 54.

The blow duct 60 may be installed at the front surface 21 of the tub 20. The blower fan 61 may be contained at the inside of the blow duct 60. The blow duct 60 may be formed so that the airflow is introduced through the back surface and is discharged through the lower surface. That is, the blow duct 60 may be formed for the discharge direction of the airflow to roughly form 90 degrees with the inlet direction of the airflow.

At the back surface of the blow duct 60, the suction port 60*a* may be provided, and at the lower surface of the blow duct 60, the discharge port 60*b* may be provided. In an example, the blower fan 61 which is installed at the inside of the blow duct 60 may use a sirocco fan.

When the blower fan 61 is rotated, the air may be suctioned into the suction port 60*a* of the blow duct 60 and then, discharged through the discharge port 60*b* which is provided at the lower surface of the blow duct 60. Accordingly, the direction of the airflow discharged from the discharge port 60*b* of the blow duct 60 may roughly form 90 degrees with the direction of the airflow which is suctioned into the suction port 60*a* of the blow duct 60.

The heat exchange part 70 may be formed to remove the moisture in the air that flows through the heat exchange flow path 52 and heat the air so as to generate hot air. The heat exchange part 70 may include the compressor 71, the evaporator 73, the condenser 72, and the expansion valve 74. In addition, the heat exchange part 70 may include the refrigerant pipe 75 through which the refrigerant circulates by connecting the compressor 71, the evaporator 73, the condenser 72, and the expansion valve 74.

The heat exchange part 70 may be formed to remove the moisture contained in the air and heat the air through heat exchange between the refrigerant and the air while the refrigerant circulates through the condenser 72, the expansion valve 74, and the evaporator 73 by the compressor 71.

The evaporator 73 and the condenser 72 may be installed at the heat exchange flow path 52. The evaporator 73 and the condenser 72 may be installed to be spaced apart from each other at a certain distance, and the condenser 72 may be installed at the downstream of the evaporator 73 in the circulating direction of the airflow.

The evaporator 73 may be connected with the back flow path 55, and may remove the moisture by cooling the humid air being discharged from the tub 20.

The condenser 72 may be connected with the blower fan 61, and may heat the air that passed the evaporator 73. Accordingly, the dried air in a high temperature may be discharged to the diaphragm 25 by the blower fan 61.

The compressor 71 may be installed at the outside of the upper flow path 50, that is, the outside of the supply flow path 53 above the tub 20. That is, the compressor 71 may be installed in the space 44 between the supply flow path 53 and the back surface of the tub 20. A refrigerant pipe 45 may be installed in the space 44 that is formed by the inlet flow path 51, the heat exchange flow path 52, the supply flow path 53, and the back surface of the tub 20 above the tub 20.

The inlet flow path 51, the heat exchange flow path 52, the supply flow path 53, the back flow path 55, and the discharge flow path 54 may be respectively formed by the inlet duct 151, the heat exchange duct 152, a supply duct 153, a back duct 155, and a discharge duct 154.

Specifically, an inner space of the inlet duct 151 may form the inlet flow path 51, an inner space of the heat exchange duct 152 may form the heat exchange flow path 52, and an inner space of the supply duct 153 may form the supply flow path 53. The heat exchange part 70, the inlet duct 151, and the supply duct 153 may form a heated air supplying device.

In addition, an inner space of the back duct 155 may form the back flow path 55, and an inner space of the discharge duct 154 may form the discharge flow path 54.

The inlet duct 151 may have a rectangular cross-section, and the back end may be connected to the back duct 155 that forms the back flow path 55. That is, the inlet 51*a* may be provided at the back surface of the inlet duct 151. The inlet duct 151 may be installed to be adjacent to the one side of the tub 20 above the tub 20. The front surface of the inlet duct 151 may be installed to be adjacent to the front surface 21 of the tub 20, and the back surface may be installed to be adjacent to the back surface of the tub 20.

At one side surface of the inlet duct 151, the outlet 51*b* may be provided. The outlet 51*b* of the inlet duct 151 may be formed to have the shape and size that corresponds to the inlet 52*a* of the heat exchange duct 152. The outlet 51*b* of the inlet duct 151 and the inlet 52*a* of the heat exchange duct 152 may be formed in a rectangular shape. The outlet 51*b* of the inlet duct 151 may be formed to be the same or greater than the size of the inlet 52*a* of the heat exchange duct 152. A width of the outlet 51*b* of the inlet duct 151 may be smaller than a length of the inlet duct 151.

The inlet 51*a* and the outlet 51*b* of the inlet duct 151 may be disposed at a right-angle.

The inlet duct 151 may be disposed at one side of the heat exchange duct 152, and may guide the air that is introduced from the back side toward the heat exchange duct 152.

At an inside of the inlet duct 151, the lint filter 81 may be disposed. The lint filter 81 may be disposed so as to be drawn out from the inlet duct 151.

The front surface of the inlet duct 151 may be opened, and a lint filter box 80 may be installed to be separated from the inlet duct 151 through the front surface. The lint filter box 80 may be installed so as to slidingly move inside the inlet duct 151. Accordingly, the lint filter box 80 may be inserted into or taken out from the inlet duct 151 from the front side of the tub 20.

The lint filter box 80 used in the washing machine with drying function according to an embodiment will be described in detail below with reference to FIGS. 8 and 9.

Figure 8:
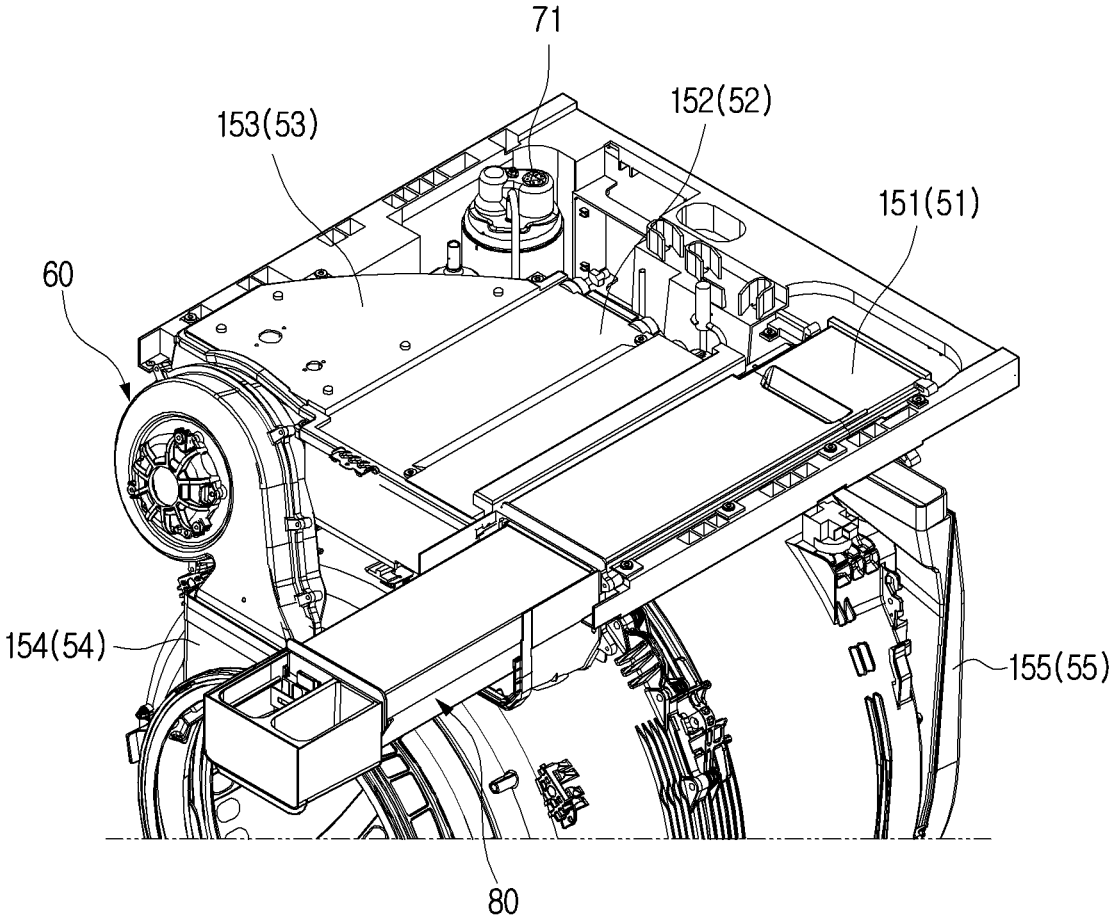
FIG. 8 is a perspective view illustrating a state in which a lint filter box of a washing machine with drying function is ejected according to an embodiment.

FIG. 8 is a perspective view illustrating a state in which a lint filter box is drawn out from a washing machine with drying function according to an embodiment. FIG. 9 is a perspective view illustrating a lint filter box of a washing machine with drying function according to an embodiment. It should be noted that FIG. 9 is a perspective view illustrating a state in which an upper surface of the lint filter box 80 is removed to show the lint filter 81.

When a user pulls out a front surface of the lint filter box 80 which is contained in the inlet duct 151, the lint filter box 80 may be protruded from the front surface 21 of the tub 20, that is, the front surface cover 11 of the cabinet 10 as shown in FIG. 8.

Figure 9:
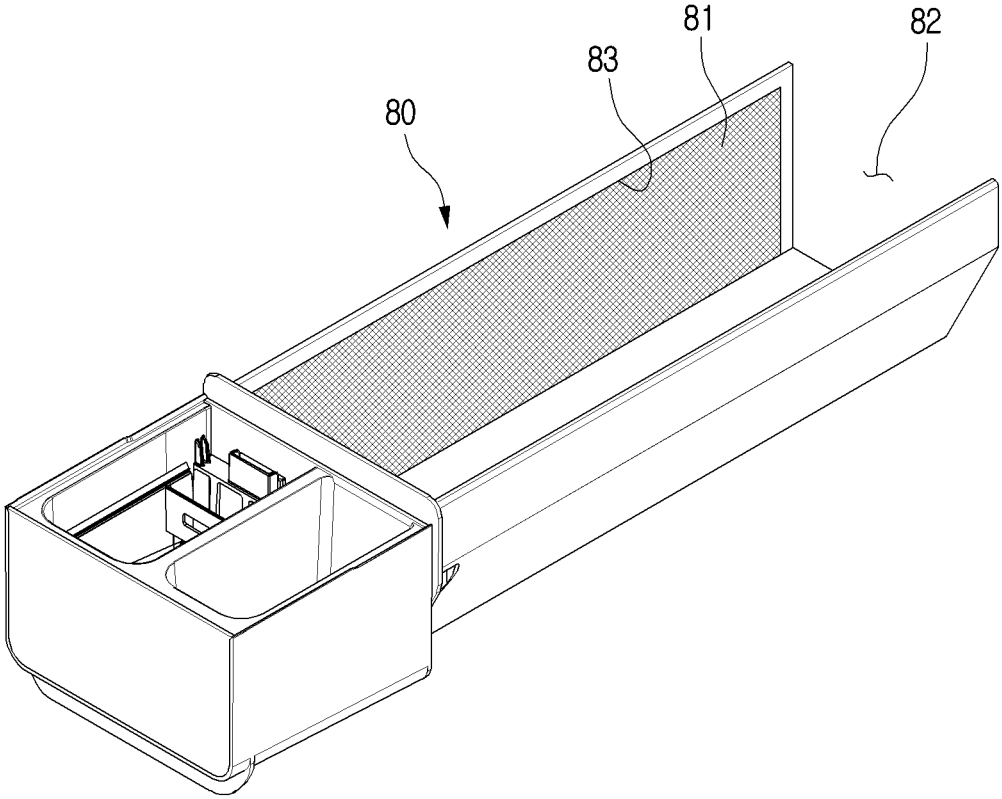
FIG. 9 is a perspective view illustrating a lint filter box of a washing machine with drying function according to an embodiment.

As shown in FIGS. 8 and 9, the lint filter box 80 may be formed roughly in a rectangular parallelepiped shape with a long length. A back end 82 of the lint filter box 80 may be opened, and a filter opening 83 may be provided at one side surface of the lint filter box 80, that is, the side surface that contacts the outlet 51*b* of the inlet duct 151. The filter opening 83 may be formed to have a shape and size that corresponds to the outlet 51*b* of the inlet duct 151.

The opened back end 82 of the lint filter box 80 may be in communication with a back end part of the inlet duct 151. Accordingly, the airflow introduced to the inlet 51*a* of the inlet duct 151 may be introduced to the inside of the lint filter box 80 through the opening of the back end 82 of the lint filter box 80.

At the filter opening 83 of the lint filter box 80, the lint filter 81 may be installed. The lint filter 81 may be installed to be separable from the filter opening 83. Accordingly, the airflow introduced into the lint filter box 80 may move to the heat exchange duct 152 through the lint filter 81. Accordingly, foreign materials such as the lint included in the airflow discharged from the tub 20 may be removed by the lint filter 81.

Because the removed foreign material is contained at an inside of the lint filter box 80, the lint filter box 80 may be emptied by separating the lint filter box 80 from the cabinet 10 of the washing machine 1. At this time, when the lint filter 81 is contaminated, the lint filter 81 installed in the lint filter box 80 may be washed or replaced. The washing machine with drying function 1 according to an embodiment having the structure as described above may easily remove foreign material such as the lint which is collected in the lint filter box 80.

The heat exchange duct 152 may have a rectangular cross-section, and may be formed such that both side ends are opened. The heat exchange duct 152 may be formed to have a widest possible cross-section area so as to fully maximize the heat transfer area.

The inlet 52*a* and the outlet 52*b* of the heat exchange duct 152 may be formed to have a cross-section that is the same as the cross-section of the heat exchange duct 152. The heat exchange duct 152 may be connected at a right-angle with the inlet duct 151. That is, the heat exchange duct 152 and the inlet duct 151 may be connected so that a center line in a length direction of the heat exchange duct 152 and a center line in a length direction of the inlet duct 151 form a right-angle.

The inlet 52*a* of the heat exchange duct 152 and the outlet 51*b* of the inlet duct 151 may be connected to each other. The outlet 51*b* of the inlet duct 151 may be formed to have a shape and size that corresponds to the inlet 52*a* of the heat exchange duct 152. The outlet 52*b* of the heat exchange duct 152 may be provided to face the inlet 52*a* of the heat exchange duct 152. That is, the outlet 52*b* and the inlet 52*a* of the heat exchange duct 152 may be disposed in a straight line.

The heat exchange duct 152 may be installed above the tub 20 so that the front surface of the heat exchange duct 152 is adjacent to the front surface 21 of the tub 20. The back surface of the heat exchange duct 152 may be spaced apart at a certain distance from the back surface of the tub 20.

At an inside of the heat exchange duct 152, the evaporator 73 and the condenser 72 of the heat exchange part 70 may be installed. That is, the heat exchange duct 152 may form the heat exchange part 70 together with the evaporator 73 and the condenser 72. Accordingly, the airflow that flows through the heat exchange duct 152 may sequentially pass the evaporator 73 and the condenser 72.

The supply duct 153 may be disposed at the other side of the heat exchange duct 152, and formed to guide the air which passed the heat exchange part 70, that is, the heat exchange duct 152, to be discharged to the front side of the tub 20.

The supply duct 153 may have a rectangular cross-section, and a front end thereof may be connected with the blow duct 60. That is, the front end of the supply duct 153 may be provided with the outlet 53*b*. The outlet 53*b* of the supply duct 153 may be formed to have a shape and size that corresponds with the suction port 60*a* of the blow duct 60.

The supply duct 153 may be installed to be adjacent to the other end of the tub 20 above the tub 20. The front surface of the supply duct 153 may be installed to be adjacent to the front surface 21 of the tub 20, and the back surface may be installed to be spaced apart at a certain distance from the back surface of the tub 20.

The supply duct 153 may be connected with the heat exchange duct 152 at a right-angle. That is, the heat exchange duct 152 and the supply duct 153 may be connected so that the center line in the length direction of the heat exchange duct 152 and a center line in a length direction of the supply duct 153 form a right-angle.

At one side surface of the supply duct 153, the inlet 53*a* may be provided. The inlet 53*a* of the supply duct 153 may be formed to have a shape and size that corresponds to the outlet 52*b* of the heat exchange duct 152. The inlet 53*a* of the supply duct 153 and the outlet 52*b* of the heat exchange duct 152 may be formed in a rectangular shape. A length of the supply duct 153 may be formed to have a length that is roughly the same as the width of the heat exchange duct 152.

The inlet 53*a* and the outlet 53*b* of the supply duct 153 may be disposed at a right-angle.

The back surface and other side surface of the supply duct 153 may be connected by an inclined surface 153*c*. Based on the above, the airflow introduced into the inlet 53*a* of the supply duct 153 may collide with the inclined surface 153*c* and be discharged through the outlet 53*b* of the supply duct 153. When the inclined surface 153*c* is installed at the supply duct 153 as described above, the airflow introduced into the supply duct 153 may be effectively guided to the outlet 53*b*. In another example, the inclined surface 153*c* of the supply duct 153 may be formed as a curved surface which can guide the airflow introduced into the inlet 53*a* to the outlet 53*b*.

The front surface of the inlet duct 151, the front surface of the heat exchange duct 152, and the front surface of the supply duct 153 may be positioned on roughly the same plane. In addition, between the one side surface of the inlet duct 151, the back surface of the heat exchange duct 152, the back surface of the supply duct 153, and the back surface of the tub 20, the space 44 may be formed. In the space 44, the compressor 71, the expansion valve 74, and the refrigerant pipe 75 of the heat exchange part 70 may be installed.

The back duct 155 may be installed at the back surface plate 22 of the tub 20, and formed to guide the airflow flowing out from the back opening 22*a* of the tub 20 toward the upper side of the tub 20. The outlet 55*b* of the back duct 155 may be formed to have a shape and size that corresponds to the inlet 51*a* of the inlet duct 151. The back duct 155 may be installed to be biased toward one side at the back surface plate 22 of the tub 20.

The discharge duct 154 may be installed at the front surface 21 of the tub 20, and formed to connect the discharge port 60*b* of the blow duct 60 and the inlet port 25*a* of the diaphragm 25. The discharge duct 154 may be formed to roughly have a rectangular cross-section.

An inlet 54*a* of the discharge duct 154 may be provided at an upper end, and an outlet 54*b* may be provided at a lower end. Accordingly, the discharge duct 154 may guide the airflow being discharged from the blow duct 60 to the diaphragm 25.

For example, the inlet 54*a* and the outlet 54*b* of the discharge duct 154 may be formed to face each other in a straight line. The inlet 54*a* of the discharge duct 154 may be connected to the discharge port 60*b* of the blow duct 60, and the outlet 54*b* of the discharge duct 154 may be connected with the inlet port 25*a* of the diaphragm 25. Accordingly, the airflow being discharged from the blow duct 60 may be introduced into the inside of the diaphragm 25, that is, the inside of the drum 30, in a straight line through the discharge duct 154.

In the embodiment, the discharge duct 154 being formed separately from the blow duct 60 has been described, but in another example, the discharge duct 154 may be formed integrally with the blow duct 60. In this case, the discharge port 60*b* of the blow duct 60 may be connected with the inlet port 25*a* of the diaphragm 25.

In the washing machine with drying function 1 according to an embodiment, the back surface plate 32 of the drum 30 may be provided with the plurality of through holes 32*a* and a pressure seal so that the airflow introduced through the front surface of the drum 30 can be discharged through the back surface plate 32 of the drum 30.

The plurality of through-holes 32*a* and the pressure seal provided at the back surface plate 32 of the drum 30 will be described in detail below with reference to FIGS. 10 to 13.

Figure 10:
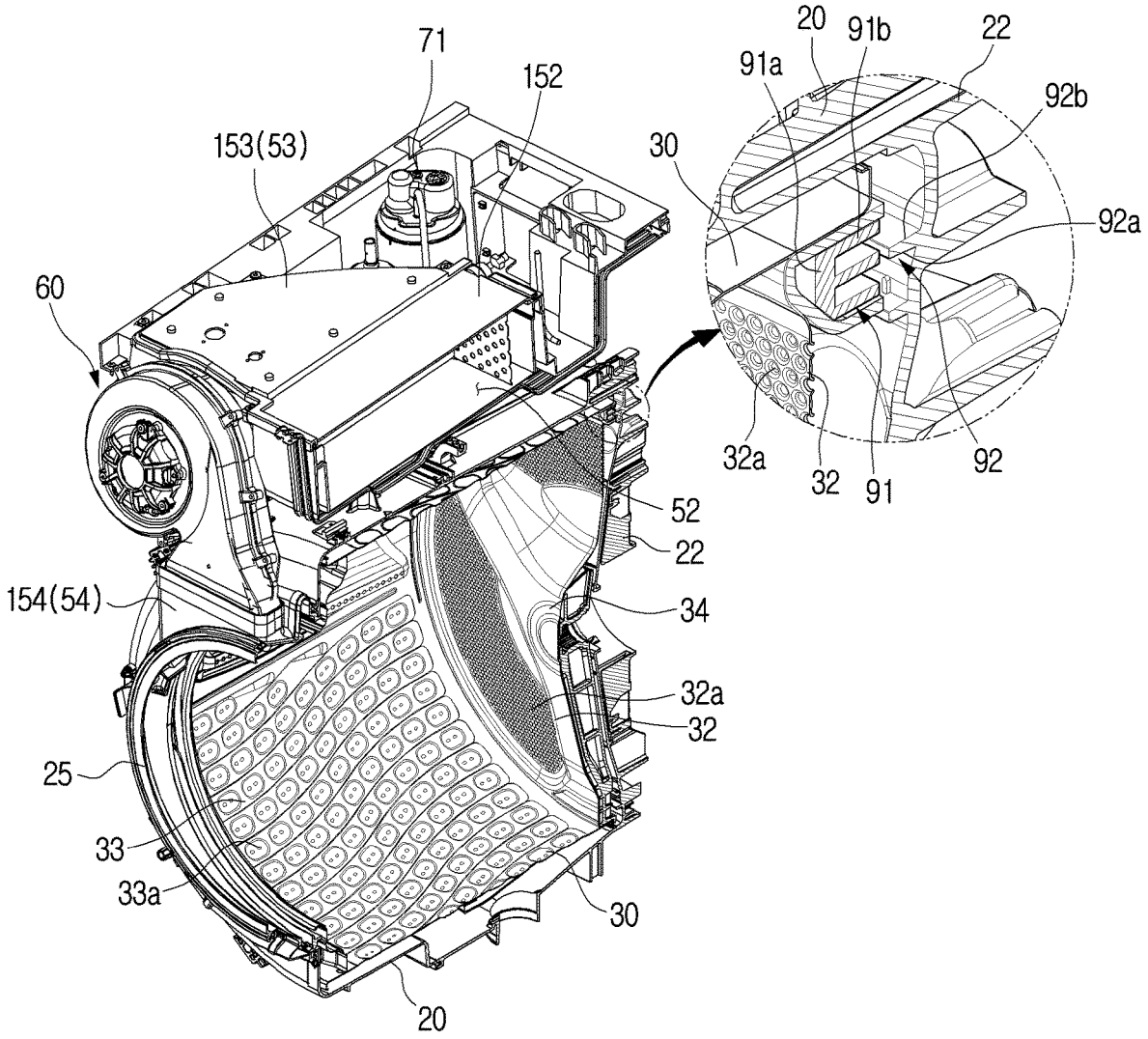
FIG. 10 is a cross-sectional perspective view illustrating a main configuration of a washing machine with drying function according to an embodiment.
Figure 11:
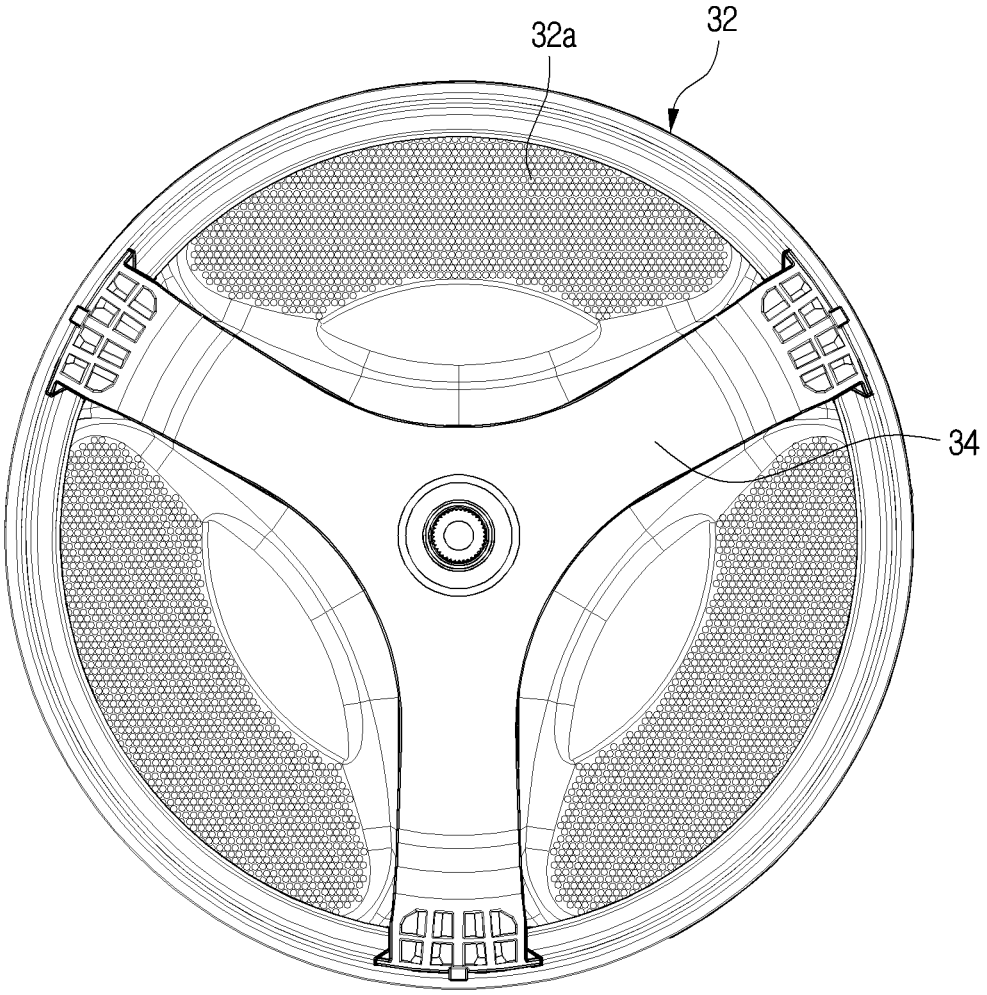
FIG. 11 is a view illustrating a back surface plate of a drum of a washing machine with drying function according to an embodiment.
Figure 12:
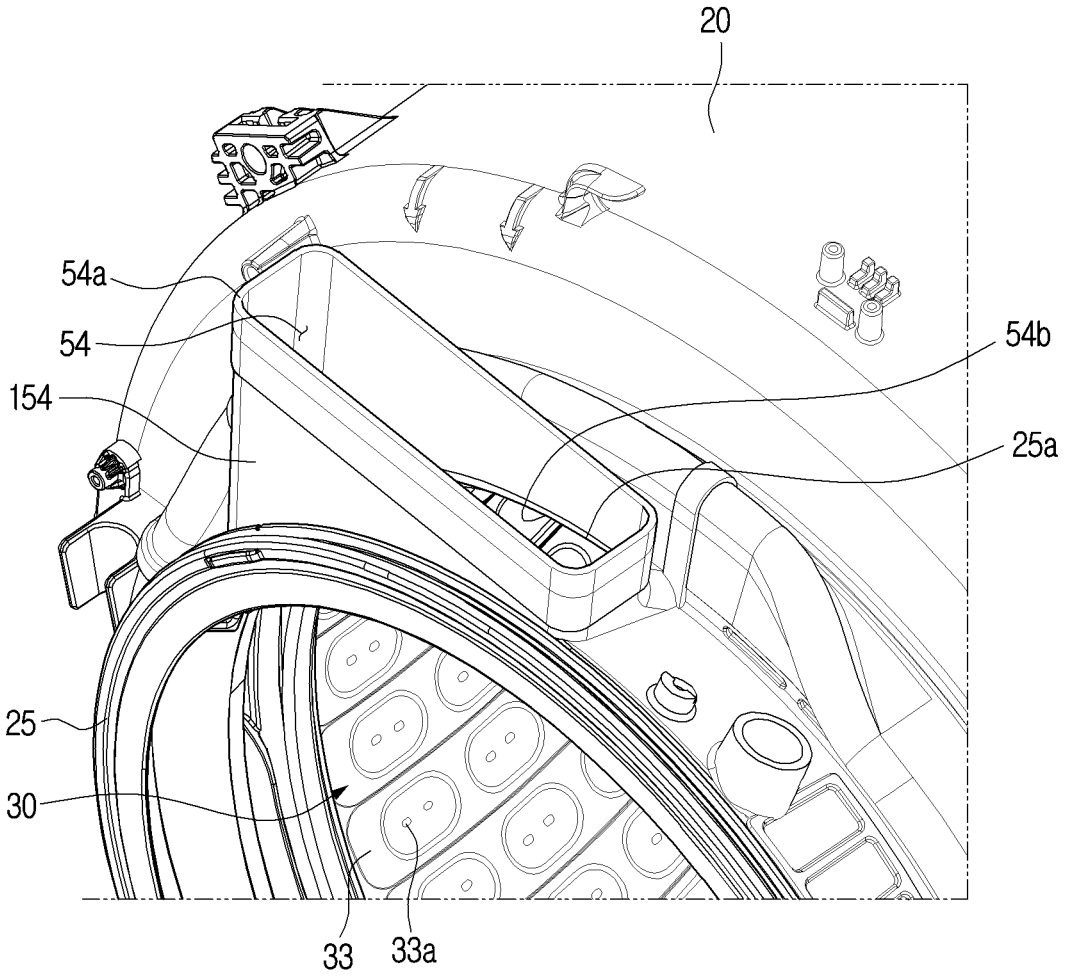
FIG. 12 is a perspective view illustrating a discharge duct of a washing machine with drying function according to an embodiment.
Figure 13:
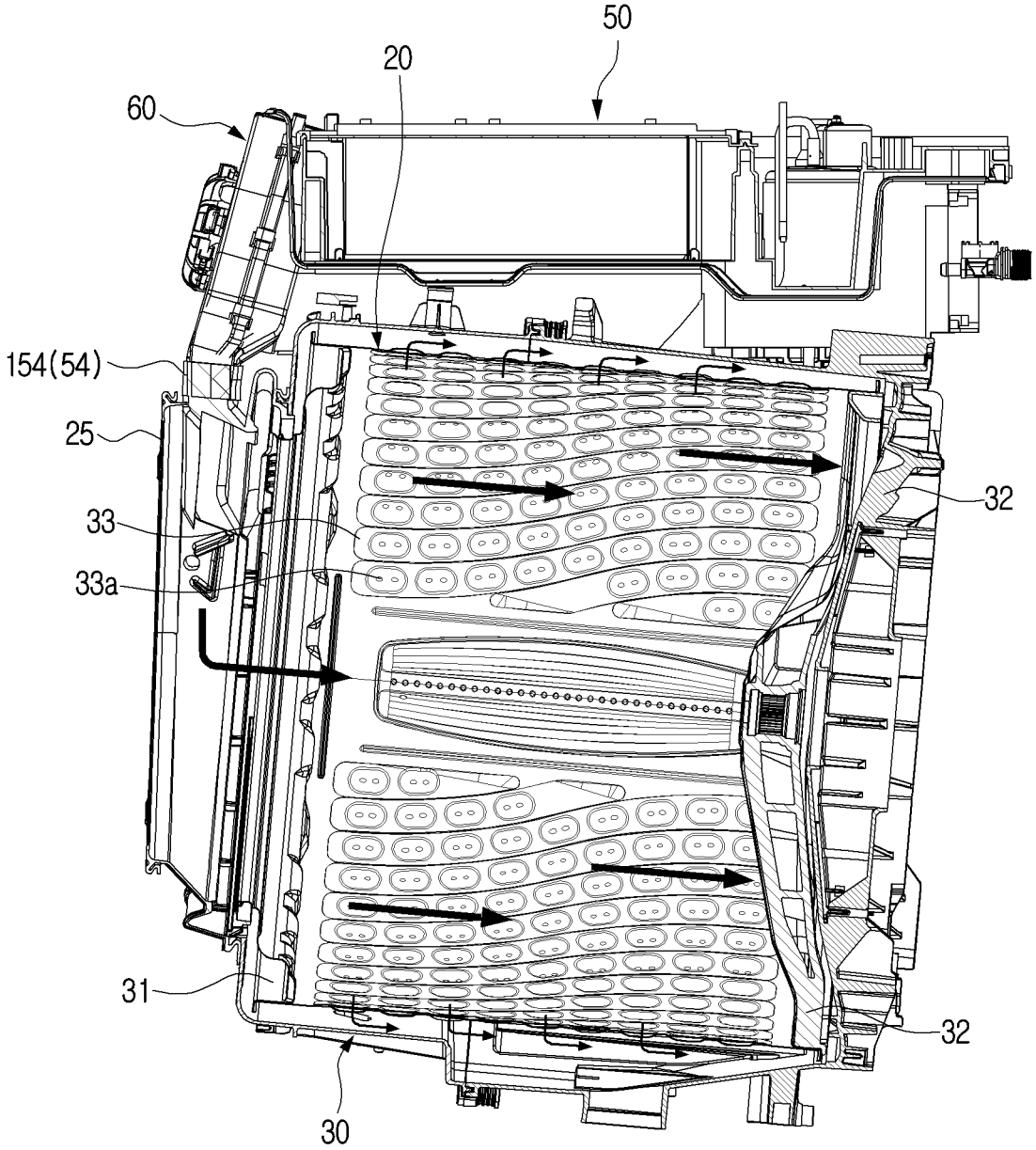
FIG. 13 is a cross-sectional view illustrating a state of airflow passing a drum of a washing machine with drying function according to an embodiment.

FIG. 10 is a cross-sectional perspective view illustrating a main configuration of a washing machine with drying function according to an embodiment. FIG. 11 is a perspective view illustrating a back surface plate of a drum of a washing machine with drying function according to an embodiment. FIG. 12 is a perspective view illustrating a discharge duct of a washing machine with drying function according to an embodiment. FIG. 13 is a cross-sectional view illustrating a state of airflow passing a drum of a washing machine with drying function according to an embodiment.

Referring to FIGS. 10 and 11, the plurality of through-holes 32*a* may be formed at the back surface plate 32 of the drum 30. The plurality of through-holes 32*a* may be formed to pass through the back surface plate 32 of the drum 30 from the front surface to the back surface. The plurality of through-holes 32*a* may be formed at all areas excluding a coupling part 36 of a flange shaft provided at the back surface plate 32 of the drum 30. For example, the plurality of through-holes 32*a* may be formed as hundreds of fine holes or more.

In addition, a whole area of the plurality of through-holes 32*a* may be formed by three times or more compared to a cross-sectional area of the discharge duct 154 which is installed at the inlet port 25*a* of the diaphragm 25. For example, when the cross-sectional area of the discharge duct 154 is 7000 $mm^2$, the whole area of the plurality of through-holes 32*a* may be 24,000 $mm^2$. Here, the cross-sectional area of the discharge duct 154 may refer to a cross-sectional area of the inlet 54*a* of the discharge duct 154 shown in FIG. 12.

As described above, when the plurality of through-holes 32*a* is formed at the back surface plate 32 of the drum 30, flow resistance of the drum 30 may be greatly reduced compared to when the plurality of through-holes 33*a* is only present at the side surface 33 of the drum 30. Accordingly, the airflow which is introduced into the drum opening 31*a* of the drum 30 may be mostly discharged to the back flow path 55 through the plurality of through-holes 32*a* of the back surface plate 32. As a result, the high temperature and dry airflow which is introduced into the front side of the drum 30 passes through all the laundry in the drum 30 and then is discharged through the plurality of through-holes 32*a* of the back surface plate 32 of the drum 30, so that the drying of the laundry may be effectively performed.

However, as shown in FIG. 13, a portion of the airflow which is introduced into the drum 30 may be discharged to the back flow path 55 through the back opening 22*a* which is formed at the back surface plate 22 of the tub 20 after being discharged into a space between the tub 20 and the drum 30 through the plurality of through-holes 33*a* which is formed at the side surface 33 of the drum 30. When the airflow is discharged through the plurality of through-holes 33*a* formed at the side surface 33 of the drum 30 as described above, drying efficiency may decrease because the airflow is unable to pass all the laundry.

To further raise the drying efficiency, the airflow inside the drum 30 may be prevented from being discharged through the plurality of through-holes 33*a* of the side surface 33 of the drum 30 as much as possible.

To this end, between the back surface of the back surface plate 32 of the drum 30 and the front surface of the back surface plate 22 of the tub 20, the pressure seal may be provided. The pressure seal may be formed as a labyrinth seal.

Referring to FIG. 10, a first labyrinth seal 91 may be provided at an edge of the back surface of the back surface plate 32 of the drum 30, and a second labyrinth seal 92 may be provided at an edge of the front surface of the back surface plate 22 of the tub 20.

The first labyrinth seal 91 may be formed as a first circular rib 91*b* which is protruded from the outer side of the back surface of the drum 30 toward the tub 20, and the second labyrinth seal 92 may be formed as a second circular rib 92*b* which is protruded from an inner side of the back surface of the tub 20 toward the drum 30.

Each of the first rib 91*b* and the second rib 92*b* may include a plurality of ribs which are formed at a certain distance. In the embodiment shown in FIG. 10, the first rib 91*b* may include three ribs which are formed at a certain distance. The second rib 92*b* may include two ribs which are formed at a certain distance.

The plurality of ribs of the first rib 91*b* may be formed to protrude from a first base 91*a*. The plurality of ribs of the second rib 92*b* may be formed to protrude from a second base 92*a*. The first base 91*a* may be installed at the outer side of the back surface of the drum 30. The second base 92*a* may be installed at the inner side of the back surface of the tub 20.

The plurality of ribs 91*b* of the first labyrinth seal 91 and the plurality of ribs 92*b* of the second labyrinth seal 92 may be alternately disposed with one another. In another example, the plurality of ribs 91*b* of the first labyrinth seal 91 and the plurality of ribs 92*b* of the second labyrinth seal 92 may be disposed to face one another.

The first labyrinth seal 91 may be installed at the back surface of the back surface plate 32 by being formed separately from the back surface plate 32 of the drum 30. The second labyrinth seal 92 may be formed separately from or integrally with the back surface plate 22 of the tub 20.

When the first and second labyrinth seals 91 and 92 are installed between the back surface of the back surface plate 32 of the drum 30 and the front surface of the back surface plate 22 of the tub 20, the great flow resistance may be generated between the back surface of the back surface plate 32 of the drum 30 and the front surface of the back surface plate 22 of the tub 20. Accordingly, a volume of air that is leaked through the plurality of through-holes 33*a* of the side surface 33 of the drum 30 and introduced between the back surface plate 32 of the drum 30 and the back surface plate 22 of the tub 20 may be minimized.

In order to check an effect of when the labyrinth seals 91 and 92 are installed between the back surface plate 32 of the drum 30 and the back surface plate 22 of the tub 20, the volume of air that is leaked through the plurality of through-holes 33*a* of the side surface 33 of the drum 30 when the labyrinth seals 91 and 92 are installed and the volume of air that is leaked through the plurality of through-holes 33*a* of the side surface 33 of the drum 30 when the labyrinth seals 91 and 92 are not installed were measured and compared. A result of which is shown in FIG. 14.

Figure 14:
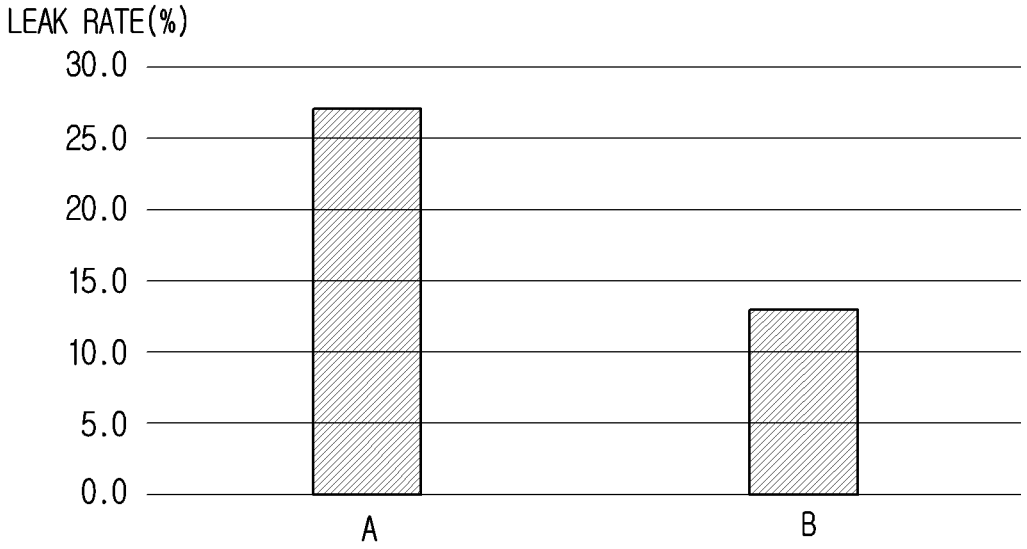
FIG. 14 is a graph illustrating a reduction in a leak of airflow at a side surface of a drum by a labyrinth seal of a washing machine with drying function according to an embodiment.

FIG. 14 is a graph illustrating a reduction in a leak of airflow at a side surface of a drum by a labyrinth seal of a washing machine with drying function according to an embodiment.

In FIG. 14, a vertical axis represents a leak rate. The leak rate represents a rate of air that is being leaked into the plurality of through-holes 33*a* of the side surface 33 of the drum 30 from among the air that is introduced into the drum 30.

A represents the leak rate of the washing machine with drying function according to an embodiment without the labyrinth seals 91 and 92, and B represents the leak rate of the washing machine with drying function 1 according to an embodiment with the labyrinth seals 91 and 92. The washing machine with drying function of A may have the same structure as the washing machine with drying function 1 of B except for the labyrinth seals 91 and 92 not being present.

Referring to FIG. 14, the leak rate A of the washing machine with drying function without the labyrinth seal may be 26.9%, but the leak rate B of the washing machine with drying function 1 with the labyrinth seals 91 and 92 may be 12.8%. Accordingly, the leak rate of air through the plurality of through-holes 33*a* of the side surface 33 of the drum 30 being reduced by half or more due to the labyrinth seal may be verified.

A drying operation of the washing machine with drying function 1 according to an embodiment having the structure as described above will be descried in detail below.

Because the washing machine with drying function 1 according to an embodiment may perform a washing cycle, a rinsing cycle, a spin drying cycle, and the like as same as a washing machine of to the related art, descriptions thereof will be omitted.

When the drying cycle is started, the processor of the washing machine with drying function 1 may operate the blower fan 61 and the compressor 71 of the heat exchange part 70.

When the compressor 71 is operated, the refrigerant may circulate through the compressor 71, the condenser 72, the expansion valve 74, and the evaporator 73. At this time, the evaporator 73 and the condenser 72 may be installed at the heat exchange duct 152, and the condenser 72 may be installed downstream of the evaporator 73 in the circulating direction of air.

When the blower fan 61 is operated, the air inside the drum 30 may circulate through the back duct 155, the inlet duct 151, the heat exchange duct 152, the supply duct 153, the blower fan 61, and the discharge duct 154, thereby drying the laundry.

For example, the humid air in the drum 30 may be discharged into a space between the back surface plate 32 of the drum 30 and the back surface plate 22 of the tub 20 through the plurality of through-holes 32*a* of the back surface plate 32 of the drum 30. The humid air that is discharged between the back surface plate 32 of the drum 30 and the back surface plate 22 of the tub 20 may be introduced into the back duct 155 through the back opening 22*a* of the tub 20.

The humid air introduced into the back duct 155 may be discharged to the inlet duct 151 through the outlet 55*b*.

The humid air introduced into the inlet 51*a* of the inlet duct 151 may flow in a direction perpendicular to the front surface cover 11 of the cabinet 10, that is, the front surface 21 of the tub 20. The humid air introduced into the inlet flow path 51 may be discharged to the heat exchange duct 152 after passing the lint filter 81. At this time, the foreign material such as the lint contained in the humid air may be collected in the lint filter box 80 by being filtered by the lint filter 81.

The foreign material collected in the lint filter box 80 may be removed by separating the lint filter box 80 from the cabinet 10 of the washing machine 1.

The humid air introduced into the inlet 52*a* of the heat exchange duct 152 may flow in a direction parallel to the front surface cover 11 of the cabinet 10. That is, the air that flows through the heat exchange duct 152 may form a right-angle with the air that flows through the inlet duct 151.

The humid air introduced into the inlet 52*a* of the heat exchange duct 152 may be removed of moisture as the air passes the evaporator 73. The moisture removed air may become heated air by being heated as it passes the condenser 72. Accordingly, at the outlet 52*b* of the heat exchange duct 152, the heated air may be discharged to the supply duct 153.

The heated air introduced into the inlet 53*a* of the supply duct 153 may flow in a direction perpendicular to the front surface cover 11 of the cabinet 10. That is, the air that flows through the supply duct 153 may form a right-angle with the air that flows through the heat exchange duct 152, and may be in parallel with the air that flows through the inlet duct 151.

The air that is discharged from the outlet 53*b* of the supply duct 153 may be introduced into the suction port 60*a* of the blow duct 60. At this time, because the outlet 53*b* of the supply duct 153 and the suction port 60*a* of the blow duct 60 are disposed in a straight line, the flow resistance of the air that is introduced into the blower fan 61 may be minimized.

The blow duct 60 may discharge the heated air suctioned into the suction port 60*a* to the lower side through the discharge port 60*b*. At this time, the direction of air that is discharged from the discharge port 60*b* of the blow duct 60 may form a right-angle with the direction of air that is suctioned into the suction port 60*a*.

The heated air from the discharge port 60*b* of the blow duct 60 may be introduced into the inside of the diaphragm 25 through the discharge duct 154. At this time, because the discharge port 60*b* of the blow duct 60 and the discharge duct 154 are disposed in a straight line, the heated air that is discharged by the blower fan 61 may be introduced into the inside of the diaphragm 25 in a straight line.

Because the diaphragm 25 is in communication with the drum opening 31*a* provided at the front surface 31 of the drum 30, the heated air may be introduced into the inside of the drum 30 through the diaphragm 25.

The heated air introduced into the inside of the drum 30 may dry the laundry by contacting the laundry. The heated air may become humid air in low temperature due to the drying of the laundry.

The humid air in the drum 30 may continue the above-described circulation by being discharged to the back duct 155 through the plurality of through-holes 33*a* of the back surface plate 32 of the drum 30.

The washing machine with drying function 1 according to an embodiment having the structure as described above may have a flow path form and the blower fan that can minimize the flow resistance and maximize the volume of air. Accordingly, the drying function of the washing machine with drying function according to an embodiment of the disclosure may be similar with the drying function of the drying-only dryer that has only the drying function without the washing function.

While the disclosure has been illustrated and described with reference to various example embodiments thereof, it will be understood that the various example embodiments are intended to be illustrative, not limiting. It will be understood by those skilled in the art that various changes in form and details may be made therein without departing from the true spirit and full scope of the disclosure, including the appended claims and their equivalents.

What is claimed is:

1. A washing machine with drying function, comprising:
a cabinet;
a tub disposed inside the cabinet, and provided with a front opening to allow laundry to be introduced and removed and a back opening;
a drum rotatable inside the tub; and
a heated air supplying device above the tub, and configured to supply heated air toward the front opening of the tub, wherein the heated air supplying device includes:
an inlet duct disposed along a first side of the tub, and formed to guide air that is introduced from a rear side of the heated air supplying device,
a heat exchange duct, including an evaporator and a condenser, and formed to guide air received from the inlet duct,
a supply duct disposed along a second side of the tub that is opposite to the first side of the tub, and formed to guide air that passed through the heat exchange duct to be discharged to a front side of the heated air supplying device, and
a fan disposed at a front side of the tub, and configured to cause an airflow such that air being discharged from the supply duct is supplied toward the front opening of the tub,
the supply duct is disposed between the heat exchange duct and the fan, and formed to connect the heat exchange duct and the fan,
the inlet duct, the heat exchange duct, and the supply duct are configured so that the air guided by the inlet duct turns in a direction perpendicular to the inlet duct to enter the heat exchange duct, and the air passing through the heat exchange duct flows across the drum in a direction from the first side of the tub to the second side of the tub and then enters the supply duct to flow toward the front side of the heated air supplying device and
the fan is configured to rotate about a rotation axis along a front and back direction of the washing machine.

2. The washing machine with drying function of claim 1, wherein the heated air supplying device includes a compressor which is disposed at a rear of the second side of the tub.

3. The washing machine with drying function of claim 1, further comprising:
a back duct formed to connect the tub and the inlet duct.

4. The washing machine with drying function of claim 3, further comprising:
a lint filter disposed inside the inlet duct.

5. The washing machine with drying function of claim 4, wherein the lint filter is disposed to be drawn out from the inlet duct.

6. The washing machine with drying function of claim 1, further comprising:
a diaphragm at the front opening of the tub; and
a blow duct formed to contain the fan, and connect to the diaphragm.

7. The washing machine with drying function of claim 1, further comprising:
a first circular rib that is provided at a back surface of an outer side of the drum and formed to protrude toward the tub; and
a second circular rib that is provided at a back surface of an inner side of the tub and formed to protrude toward the drum.

8. A washing machine with drying function, comprising:
a cabinet;
a tub that is circular inside the cabinet, and provided with a front opening to allow laundry to be introduced and removed and a back opening;
a diaphragm at the front opening of the tub;
a drum rotatable inside the tub; and
a heated air supplying device configured to supply heated air to an inside of the tub,
wherein the heated air supplying device includes:
an inlet duct disposed at a first side of the tub along a length direction of the tub, and formed to guide air being discharged from a rear side of the tub,
a heat exchange duct, including an evaporator and a condenser, and formed to guide air received from the inlet duct,
a supply duct disposed at a second side of the tub that is opposite to the first side of the tub, along the length direction of the tub, and formed to guide air that passed through the heat exchange duct to be discharged to a front side of the tub,
a fan at the front side of the tub, and
a blow duct formed to contain the fan, and connect the supply duct with the diaphragm,
wherein the supply duct is disposed between the heat exchange duct and the fan, and formed to connect the heat exchange duct and the fan,
the inlet duct, the heat exchange duct, and the supply duct are configured so that the air guided by the inlet duct turns in a direction perpendicular to the inlet duct to enter the heat exchange duct, and the air passing through the heat exchange duct flows across the drum in a direction from the first side of the tub to the second side of the tub and then enters the supply duct to flow toward the front side of the tub, and
the fan is configured to rotate about a rotation axis along a front and back direction of the washing machine.

9. The washing machine with drying function of claim 8, further comprising:
a lint filter disposed inside the inlet duct.

10. The washing machine with drying function of claim 9, wherein the lint filter is disposed to be drawn out from the inlet duct.

11. The washing machine with drying function of claim 8, further comprising:

a first circular rib that is provided at a back surface of an outer side of the drum and formed to protrude toward the tub; and a second circular rib that is provided at a back surface of an inner side of the tub and formed to protrude toward the drum.

12. The washing machine with drying function of claim 8, wherein the heated air supplying device includes a compressor which is disposed at a rear of the second side of the tub.

13. The washing machine with drying function of claim 8, further comprising:

a back duct formed to connect the tub and the inlet duct.

14. A washing machine with drying function, comprising:

a cabinet;

a tub disposed inside the cabinet, and provided with a front opening to allow laundry to be introduced and removed and a back opening;

a drum rotatable inside the tub; and a heated air supplying device above the tub, and configured to supply heated air toward the front opening of the tub, wherein the heated air supplying device includes:

an inlet duct disposed at a first side of the tub, and formed to guide air that is introduced from a rear side of the heated air supplying device, a heat exchange duct, including an evaporator and a condenser, and formed to guide air received from the inlet duct, a supply duct disposed at a second side of the tub, and formed to guide air that passed through the heat exchange duct to be discharged to a front side of the heated air supplying device, and a fan disposed at a front side of the tub, and configured to rotate about a rotation axis along a front and back direction of the washing machine to cause an airflow such that air being discharged from the supply duct is supplied toward the front opening of the tub, wherein the supply duct is disposed between the heat exchange duct and the fan, and formed to connect the heat exchange duct and the fan, and wherein the inlet duct, the heat exchange duct, and the supply duct are configured so that the air guided by the inlet duct turns in a direction perpendicular to the inlet duct to enter the heat exchange duct, and the air passing through the heat exchange duct turns in a direction perpendicular to the heat exchange duct to enter the supply duct.

* * * * *